US008306827B2

(12) United States Patent
Yamanashi et al.

(10) Patent No.: US 8,306,827 B2
(45) Date of Patent: Nov. 6, 2012

(54) CODING DEVICE AND CODING METHOD WITH HIGH LAYER CODING BASED ON LOWER LAYER CODING RESULTS

(75) Inventors: Tomofumi Yamanashi, Kanagawa (JP); Kaoru Sato, Kanagawa (JP); Toshiyuki Morii, Kanagawa (JP); Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1035 days.

(21) Appl. No.: 12/282,287

(22) PCT Filed: Mar. 8, 2007

(86) PCT No.: PCT/JP2007/054528

§ 371 (c)(1),
(2), (4) Date: Sep. 9, 2008

(87) PCT Pub. No.: WO2007/105586

PCT Pub. Date: Sep. 20, 2007

(65) Prior Publication Data

US 2009/0094024 A1 Apr. 9, 2009

(30) Foreign Application Priority Data

Mar. 10, 2006 (JP) ..... 2006-066771
Feb. 13, 2007 (JP) ..... 2007-032746

(51) Int. Cl.
*G10L 19/12* (2006.01)

(52) U.S. Cl. ..... 704/500; 704/501; 704/504

(58) Field of Classification Search ..... 704/500–504, 704/200–278

See application file for complete search history.

(56) References Cited

U.S. PATENT DOCUMENTS 6,094,636 A * 7/2000 Kim ..... 704/500
6,122,618 A * 9/2000 Park ..... 704/500

(Continued)

FOREIGN PATENT DOCUMENTS

JP 9-127998 5/1997

(Continued)

OTHER PUBLICATIONS

Brandenburg et al. "MPEG-4 natural audio coding", Signal Processing: Image Communication, vol. 15, pp. 423-444, Published in 2000.*

(Continued)

*Primary Examiner* — Jialong He
(74) *Attorney, Agent, or Firm* — Greenblum & Bernstein, P.L.C.

(57) ABSTRACT

A coding device is provided with features in which optimum coding in a higher layer is flexibly carried out based on a coding result of a lower layer and a quality audio signal in limited circumstances is served to users. In this coding device, a basic layer coding unit codes an input signal to generate a basic layer information source code and outputs a linear prediction coefficient (LPC) and a quantum LPC, which are parameters calculated at coding, to an expanded layer control unit. A basic layer decoding unit decodes the basic layer information source code. An adding unit reverses a polarity of a basic layer decoded signal, adds the same to the input signal, and calculates a difference signal. The expanded layer control unit generates expanded layer mode information indicative of a coding mode in an expanded layer based on the LPC and the quantum LPC. An expanded layer coding unit codes the difference signal obtained from the adding unit under control of the expanded layer control unit.

8 Claims, 19 Drawing Sheets

U.S. PATENT DOCUMENTS

| | | | | |
|---|---|---|---|---|
| 6,182,031 | B1 * | 1/2001 | Kidder et al. | 704/205 |
| 6,208,957 | B1 | 3/2001 | Nomura | |
| 6,349,284 | B1 * | 2/2002 | Park et al. | 704/500 |
| 6,446,037 | B1 * | 9/2002 | Fielder et al. | 704/229 |
| 6,871,106 | B1 | 3/2005 | Ishikawa et al. | |
| 7,177,804 | B2 * | 2/2007 | Wang et al. | 704/219 |
| 7,277,849 | B2 * | 10/2007 | Streich et al. | 704/229 |
| 7,283,966 | B2 * | 10/2007 | Zhang et al. | 704/500 |
| 7,299,174 | B2 * | 11/2007 | Sato et al. | 704/219 |
| 7,702,504 | B2 * | 4/2010 | Son et al. | 704/219 |
| 7,769,584 | B2 * | 8/2010 | Oshikiri et al. | 704/230 |
| 7,835,904 | B2 * | 11/2010 | Li et al. | 704/200.1 |
| 2002/0007269 | A1 * | 1/2002 | Gao | 704/212 |
| 2002/0111800 | A1 * | 8/2002 | Suzuki et al. | 704/220 |
| 2003/0154074 | A1 | 8/2003 | Kikuiri et al. | |
| 2004/0013245 | A1 | 1/2004 | Yokoyama | |
| 2004/0181394 | A1 * | 9/2004 | Kim et al. | 704/200.1 |
| 2005/0004794 | A1 | 1/2005 | Son et al. | |
| 2005/0163323 | A1 | 7/2005 | Oshikiri | |
| 2005/0246178 | A1 * | 11/2005 | Fejzo | 704/500 |
| 2005/0252361 | A1 * | 11/2005 | Oshikiri | 84/605 |
| 2006/0173677 | A1 * | 8/2006 | Sato et al. | 704/223 |
| 2008/0010072 | A1 | 1/2008 | Yoshida et al. | |
| 2008/0033717 | A1 | 2/2008 | Sato et al. | |
| 2008/0063084 | A1 | 3/2008 | Xue et al. | |
| 2008/0069245 | A1 | 3/2008 | Kadono et al. | |
| 2008/0130761 | A1 | 6/2008 | Kadono et al. | |

FOREIGN PATENT DOCUMENTS

| | | |
|---|---|---|
| JP | 10-97295 | 4/1998 |
| JP | 11-30997 | 2/1999 |
| JP | 11-330977 | 11/1999 |
| JP | 2003-233400 | 8/2003 |
| JP | 2003-323199 | 11/2003 |
| JP | 2004-199064 | 7/2004 |
| JP | 2004-301954 | 10/2004 |
| JP | 2005-25203 | 1/2005 |
| JP | 2005-80063 | 3/2005 |
| JP | 2005-316499 | 11/2005 |

OTHER PUBLICATIONS

Koishida et al. "A 16-KBIT/S Bandwidth Scalable Audio Coder Based on the G.729 Standard", International Conference on Acoustic, Speech and Signal Processing (ICASSP), 2000.*

English language Abstract of JP 2005-80063, Mar. 24, 2005.

English language Abstract of JP 9-127998, May 16, 1997.

English language Abstract of JP 2005-25203, Jan. 27, 2005.

English language Abstract of JP 11-30997, Feb. 2, 1999.

English language Abstract of JP 11-330977, Nov. 30, 1999.

English language Abstract of JP 2004-199064, Jul. 15, 2004.

English language Abstract of JP 2005-316499, Nov. 10, 2005.

English language Abstract of JP 2003-233400, Aug. 22, 2003.

English language Abstract of JP 2003-323199, Nov. 14, 2003.

English language Abstract of JP 2004-301954, Oct. 28, 2004.

English language Abstract of JP 10-97295, Apr. 14, 1998.

Ramprashad S. A, "Embedded Coding Using a Mixed Speech and Audio Coding Paradigm", International Journal of Speech Technology, Kluwer Academic Publishers, The Netherlands, vol. 2, No. 4, XP002503923, May 1, 1999, pp. 359-372.

Supplementary Partial European Search Report, mailed Aug. 21, 2012, from European Patent Office (EPO) for corresponding European patent application.

* cited by examiner

CODING DEVICE AND CODING METHOD WITH HIGH LAYER CODING BASED ON LOWER LAYER CODING RESULTS

TECHNICAL FIELD

The present invention relates to a coding apparatus and coding method used in a communication system where signals are encoded and transmitted.

BACKGROUND ART

In recent years, for speech signal and audio signal coding, scalable coding techniques have been developed whereby speech and audio signals can be decoded from a portion of encoded information to reduce sound quality deterioration even under conditions in which packet loss occurs (for example, see Patent Document 1). With these scalable coding techniques, it is possible to decode speech and audio signals from a portion of encoded information to reduce sound quality deterioration even under conditions in which packet loss occurs. To be more specific, one representative example is a method of repeating: encoding an input signal and generating encoded information of the first layer; generating in the (i−1)-th layer representing the higher layer (i is an integral number equal to or greater than 2), a residual signal showing the difference between the input signal and a decoded signal acquired according to encoded information of the (i−1)-th layer; and performing coding according to a residual signal in the i-th layer representing the much higher layer.

Further, another method of switching between operating and not operating of the coding section in a higher layer based on a comparison result between the coding result of the lower layer and a predetermined threshold, is proposed (e.g., see Patent Document 2).

Patent Document 1: Japanese Patent Application Laid-Open No. Hei 10-97295

Patent Document 2: Japanese Patent Application Laid-Open No. 2005-80063

DISCLOSURE OF INVENTION

Problem to be Solved by the Invention

Above Patent Document 1 discloses a method of, upon encoding the residual signal in a higher layer, encoding the residual signal by a predetermined coding scheme not taking into account the coding result of the lower layer sufficiently. The relationship between the lower layer and the higher layer is fixed, and, consequently, under certain limited conditions, not necessarily optimal coding is performed to provide a speech signals in good quality.

Further, above Patent Document 2 discloses a method taking into account the coding result in a lower layer. However, the method is primarily directed to adjusting the bit rate for higher layers to prevent overflow of transmission buffers when the channel is congested, and, if the channel is not congested, not necessarily optimal coding performed to provide speech signals in good quality.

It is therefore an object of the present invention to provide, upon encoding residual signal in a higher layer, a speech signal of good quality under limited conditions by flexibly performing optimal coding, taking into account the coding result in a lower layer.

Means for Solving the Problem

The coding apparatus of the present invention that encodes an input signal by information of n layers (n is an integral number equal to or greater than 2), employs a configuration having: a base layer coding section that encodes the input signal and generates encoded information of a first layer; an i-th layer decoding section that decodes encoded information of an i-th layer (i is an integral number between 1 and n−1) and generates a decoded signal of the i-th layer; an adding section that finds one of a first layer difference signal representing a difference between the input signal and a decoded signal of the first layer, and an i-th layer difference signal representing a difference between a difference signal of an (i−1)-th layer and a decoded signal of the i-th layer; a (i+1)-th layer enhancement layer coding section that encodes the difference signal of the i-th layer and generates encoded information of a (i+1)-th layer; and an enhancement layer control section that controls a coding method in a coding section in a higher layer than a predetermined layer according to coding parameters for a coding section in the predetermined layer.

The coding method of the present invention that encodes an input signal by information of n layers (n is an integral number greater than 2), employs a method having: a base layer coding step of encoding the input signal and generates encoded information of a first layer; an i-th layer decoding step of decoding encoded information of an i-th layer (i is an integral number equal to or greater than 1 and equal to or less than n−1) and generates a decoded signal of the i-th layer; an adding step of finding a difference signal of a first layer representing a difference between the input signal and a decoded signal of the first layer or a difference signal of an i-th layer representing a difference between a difference signal of a (i−1) layer and the decoded signal of the i-th layer; a (i+1)-th layer enhancement layer coding step of encoding the difference signal of the i-th layer and generating encoded information of a (i+1)-th layer; and an enhancement layer controlling step of controlling a coding method in a coding section in a higher layer than a predetermined layer according to coding parameters of a coding section in the predetermined layer.

Advantageous Effect of the Invention

According to the present invention, in a scalable coding technique, taking into account the coding result in a lower layer, the coding scheme for a higher layer is switched flexibly so that speech signals have optimal quality taking into account both the coding result of the lower layer and the coding result of the higher layer, so that it is possible to provide speech signals of good quality to the user regardless of how much the channel is congested.

BEST MODE FOR CARRYING OUT THE INVENTION

Embodiments of the present invention will be explained below in detail with reference to the accompanying drawings.

Further, in the following explanations, assume that the coding and decoding are performed in a layered manner using the CELP (Code-Excited Linear Prediction) method. Further, an example will be explained below where a scalable coding technique for two layers comprised of the base layer and one enhancement layer, is employed. Here, hierarchies (hereinafter "layers") are referred to as the "base layer," "first enhancement layer," "second enhancement layer," "third enhancement layer," . . . in order from the bottom layer. Layers other than the base layer are referred to as "enhancement layers."

A scalable coding technique refers to the technique of securing scalability by layer classification, such that data of all layers are transmitted when sufficient bit rates showing communication rates can be ensured by performing layering, and data from the lower layer to the higher layer are transmitted according to the bit rates when sufficient bit rates cannot be ensured by performing layering.

Embodiment 1

Figure 1:
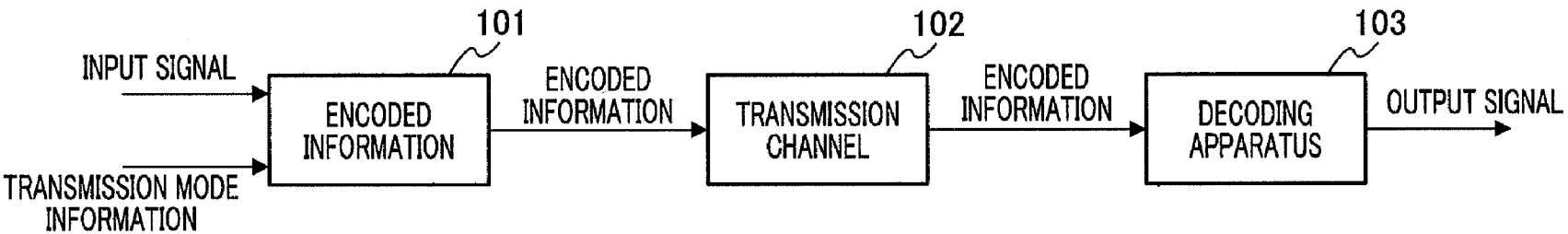
FIG. 1 illustrates a configuration of a communication system having a coding apparatus and decoding apparatus according to Embodiment 1 of the present invention.

FIG. 1 is a block diagram showing a communication system having the coding apparatus and decoding apparatus according to Embodiment 1 of the present invention. In FIG. 1, the communication system is provided with coding apparatus 10 and decoding apparatus 103.

Coding apparatus 101 receives as input an input signal and transmission mode information, encodes the input signal based on the transmission mode information and transmits the encoded information to decoding apparatus 103 via channel 102. Decoding apparatus 103 receives and decodes the encoded information transmitted from coding apparatus 101 via channel 102, generates an output signal based on the decoded transmission mode information and outputs this output signal to the apparatus in the subsequent step. Here, assume that the transmission mode information refers to the bit rate at which coding apparatus 101 transmits encoded information to decoding apparatus 103 and is either BR1 or BR2 (BR1<BR2).

Figure 2:
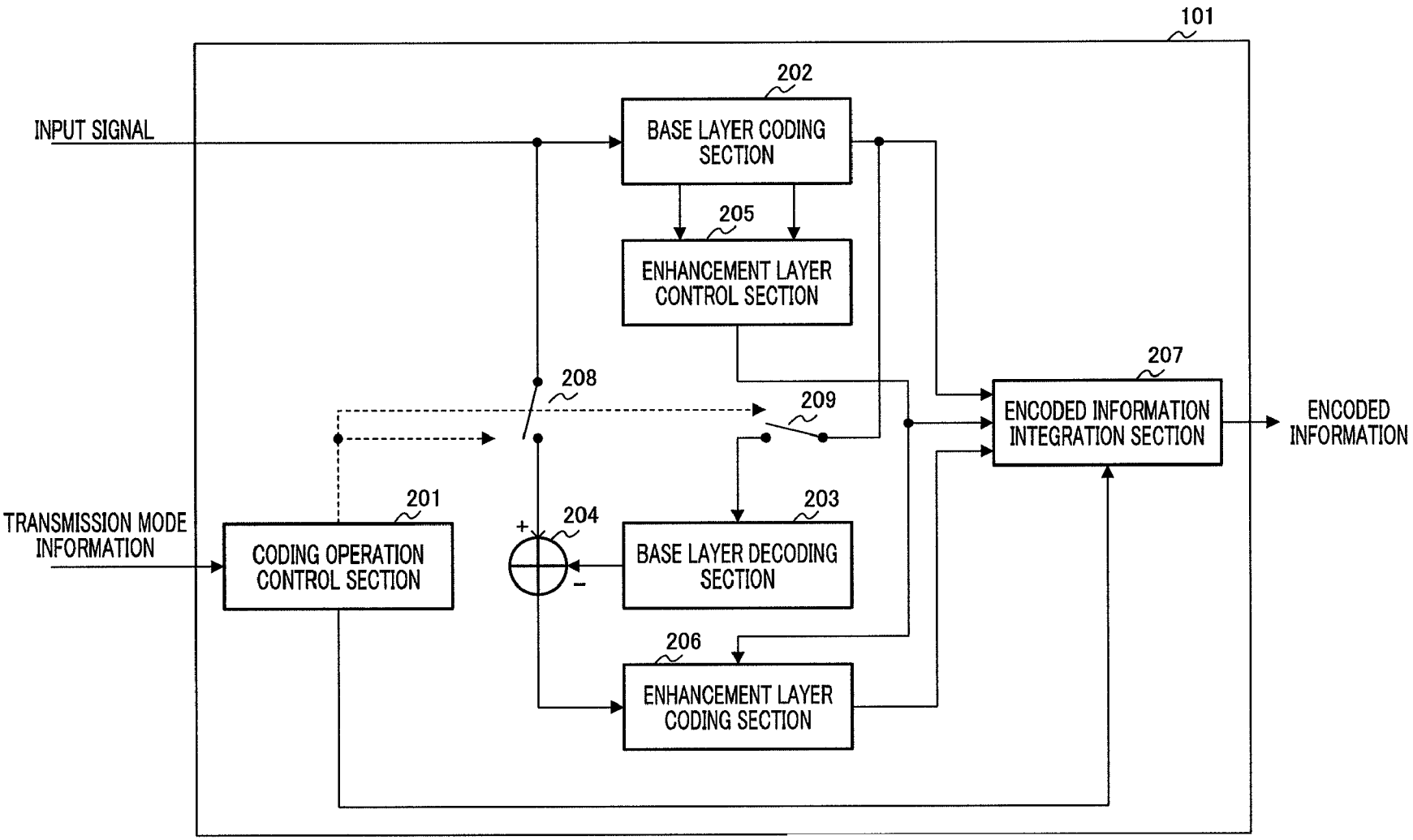
FIG. 2 is a block diagram showing a configuration of a coding apparatus according to Embodiment 1 of the present invention.

FIG. 2 is a block diagram showing the configuration of coding apparatus 101 according to the present embodiment. As shown in FIG. 2, coding apparatus 101 is configured mainly with coding operation control section 201, base layer coding section 202, base layer decoding section 203, adding section 204, enhancement layer control section 205, enhancement layer coding section 206, encoded information integration section 207 and control switches 208 and 209.

Coding operation control section 201 receives as input transmission mode information. Coding operation control section 201 performs the on/off control of switches 208 and 209 according to the inputted transmission mode information. To be more specific, when the transmission mode information shows BR2, coding operation control section 201 makes control switches 208 and 209 all on. When the transmission mode information shows BR1, coding operation control section 201 makes control switches 208 and 209 all off. Further, the transmission mode information is inputted to coding operation control section 201 as above and also inputted to encoded information integration section 207 through coding operation control section 201 as shown in FIG. 2 or directly inputted to encoded information integration section 207 without passing coding operation control section 201. Thus, coding operation control section 201 performs the on/off control of a control switch group based on transmission mode information, thereby determining the combinations of coding sections for use to encode an input signal.

Base layer coding section 202 generates an encoded information for the base layer by encoding the input signal of an speech signal or the like using a CELP type speech coding method, and outputs the generated base layer encoded information to encoded information integration section 207 and control switch 209. Further, base layer coding section 202 outputs the LPC (Linear Prediction Coefficients) and quantized LPC, which are parameters calculated upon speech-coding the input signal, to enhancement layer control section 205. The internal configuration of base layer coding section 202 will be described later in detail.

When control switch 209 is on, base layer decoding section 203 generates the decoded signal for the base layer by decoding the encoded information for the base layer outputted from base layer coding section 202 using a CELP type speech decoding method, and outputs this base layer decoded signal to adding section 204. On the other hand, when control switch 209 is off, base layer decoding section 203 does not operate. The internal configuration of base layer decoding section 203 will be described later in detail.

When control switch 208 is on, adding section 204 calculates the difference signal by inverting the polarity of the decoded signal for the base layer and adding this and the input signal, and outputs this difference signal to enhancement layer coding section 206. On the other hand, when control switch 208 is off, adding section does not operate.

Enhancement layer control section 205 generates mode information of the enhancement layer based on the LPC and quantized LPC outputted from base layer coding section 202, and outputs the enhancement layer mode information to enhancement layer coding section 206 and encoded information integration section 207. This enhancement layer mode information refers to information showing the coding mode of the enhancement layer, and is used to decode the encoded information of the enhancement layer in the decoding apparatus. The internal configuration of enhancement layer control section 205 will be described later in detail.

When control switches 208 and 209 are on, according to the control of enhancement layer control section 205, enhancement layer coding section 206 generates an encoded information of the enhancement layer by encoding the difference signal acquired from adding section 204 using a CELP type speech coding method, and outputs the enhancement layer encoded information to encoded information integration section 207. On the other hand, when control switches 208 and 209 are off, enhancement layer coding section 206 does not operate. The control method for enhancement layer coding section 206 by enhancement layer control section 205 will be described later in detail.

Encoded information integration section 207 generates encoded information by integrating the encoded information outputted from base layer coding section 202 and enhancement layer coding section 206, the mode information of the enhancement layer outputted from enhancement layer control section 205 and the transmission mode information outputted from coding operation control section 201, and outputs this generated encoded information to channel 102.

Figure 3A:
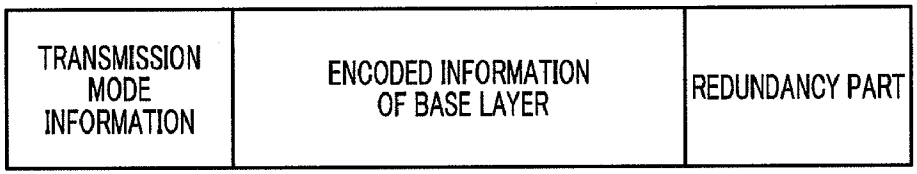
FIG. 3 illustrates bit stream configurations of coding information according to Embodiment 1 of the present invention.
Figure 3B:
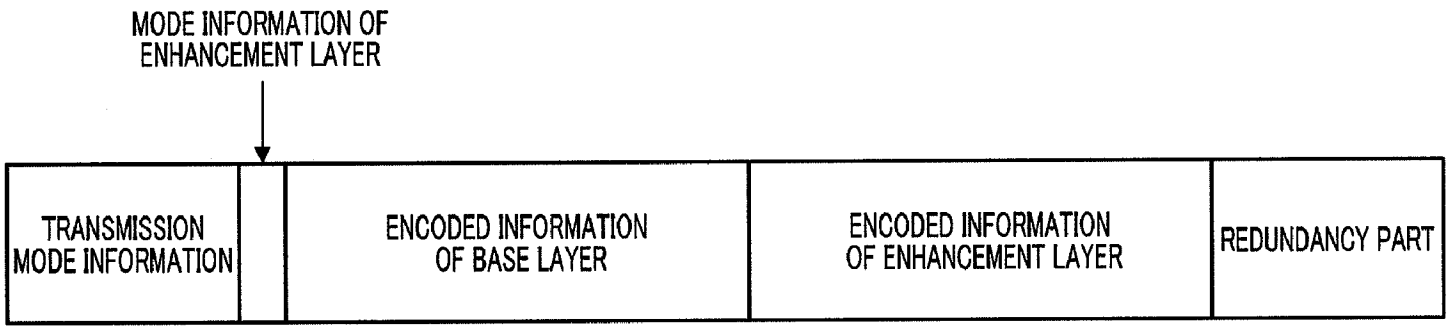

Next, the data structure (bit streams) of encoded information before transmission will be explained using FIG. 3. When the transmission mode information shows BR1, as shown in FIG. 3A, the encoded information is comprised of transmission mode information, encoded information for the base layer and a redundancy part. When the transmission mode information shows BR2, as shown in FIG. 3B, the encoded information is comprised of transmission mode information, base layer encoded information, encoded information of the enhancement layer, mode information of the enhancement layer and a redundancy part. Here, the redundancy part in the data structure of FIG. 3 refers to a redundant data storage part prepared in the bit stream and is utilized for, for example, transmission error detection and correction and a counter to synchronize with packets.

Figure 4:
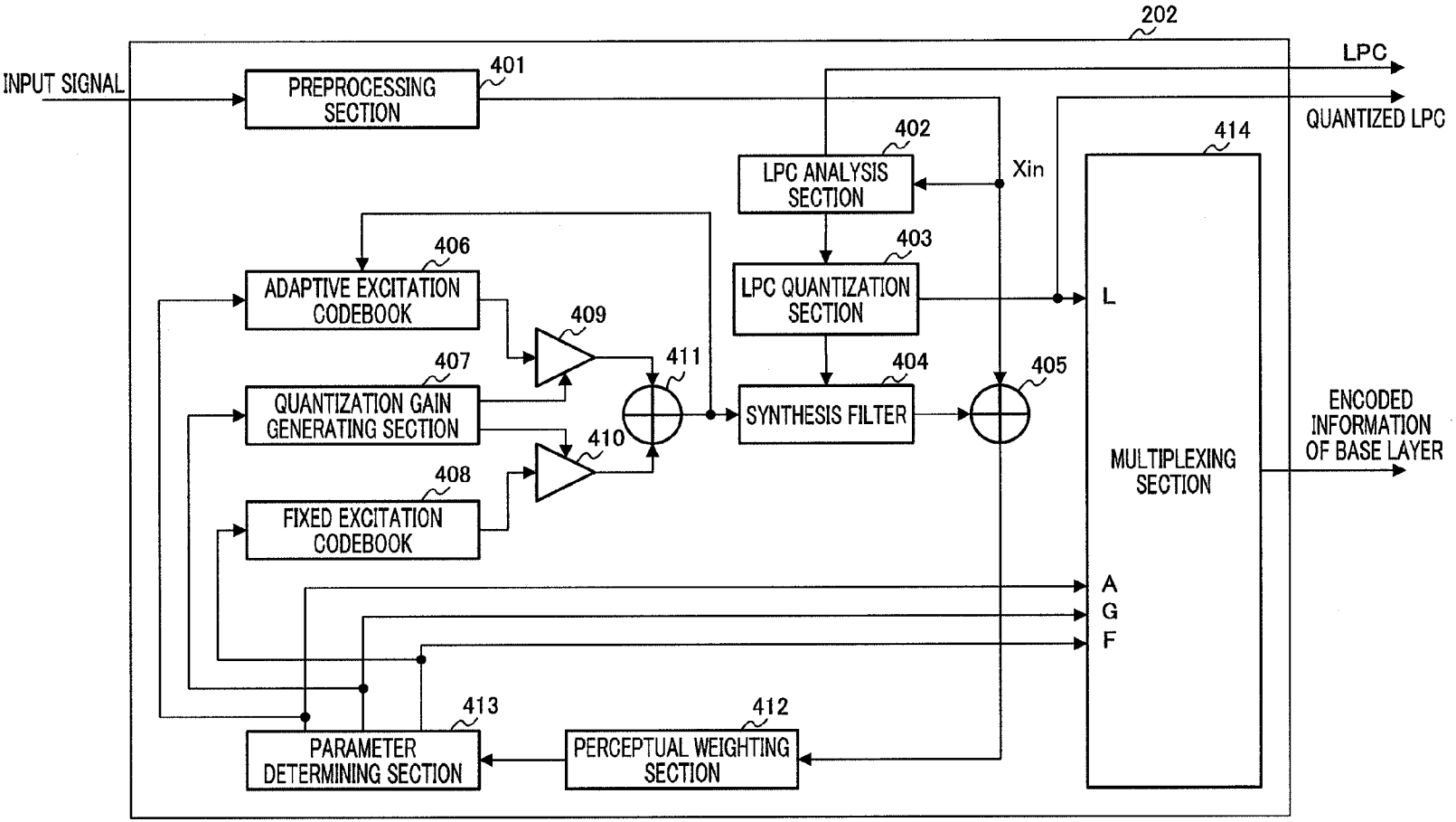
FIG. 4 is a block diagram showing an internal configuration of a base layer coding section in a coding apparatus according to Embodiment 1 of the present invention.

Next, the internal configuration of base layer coding section 202 of FIG. 2 will be explained using FIG. 4. Preprocessing section 401 processes the input signal by performing highpass filter processing that removes the DC components, waveform shaping processing and preemphasis processing that lead to improved performance in subsequent coding processing, and outputs signal (Xin) after these processing to LPC analysis section 402 and adding section 405.

LPC analysis section 402 performs linear predictive analysis using Xin, and outputs the LPC representing the analysis result to LPC quantization section 403 and enhancement layer control section 205. LPC quantization section 403 performs quantization processing of the LPC outputted from LPC analysis section 402, outputs the quantized LPC to synthesis filter 404 and enhancement layer control section 205 and outputs the code (L) representing the quantized LPC to multiplexing section 414. Synthesis filter 404 generates a synthesis signal by performing filter synthesis with respect to excitation outputted from addition section 411, which is described later, using filter coefficients based on the quantized LPC, and outputs the synthesis signal to adding section 405. Adding section 405 calculates an error signal by inverting the polarity of the synthesis signal and adding the result to Xin, and outputs the error signal to perceptual weighting section 412.

Adaptive excitation codebook 406 that stores the excitations outputted in the past by adding section 411 in a buffer extracts one frame of samples from the past excitations specified by a signal to be outputted from parameter determining section 413 as an excitation vector, and outputs the result to multiplying section 409. Quantization gain generating section 407 outputs the quantized adaptive excitation gain and quantized fixed excitation gain specified by the signal outputted from parameter determining section 413 to multiplying section 409 and multiplying section 410, respectively. Fixed excitation codebook 408 selects the pulse excitation vector with the waveform specified by the signal outputted from parameter determining section 413, and outputs this pulse excitation vector to multiplying section 410 as a fixed excitation vector. Further, fixed excitation codebook 408 may generate a fixed excitation vector by multiplying the selected pulse excitation vector by a spreading vector, and output this fixed excitation vector to multiplying section 410.

Multiplying section 409 multiplies the adaptive excitation vector outputted from adaptive excitation codebook 406 by the quantized adaptive excitation gain outputted from quantization gain generating section 407, and outputs the result to adding section 411. Multiplying section 410 multiplies the fixed excitation vector outputted from fixed excitation codebook 408 by the quantized fixed excitation gain outputted from quantization gain generating section 407, and outputs the result to adding section 411. Adding section 411 adds the adaptive excitation vector and fixed excitation vector after the gain multiplication, and outputs the excitation indicating the addition result to synthesis filter 404 and adaptive excitation codebook 406. Further, the excitation inputted to adaptive excitation codebook 406 is stored in a buffer.

Perceptual weighting section 412 performs perceptual weighting for the error signal outputted from adding section 405 and outputs the result to parameter determining section 413 as coding distortion. Parameter determining section 413 selects the adaptive excitation vector, fixed excitation vector, and quantization gain that minimize the coding distortion outputted from perceptual weighting section 412, from adaptive excitation codebook 406, fixed excitation codebook 408, and quantization gain generation section 407, respectively, and outputs the adaptive excitation vector code (A), fixed excitation vector code (F) and excitation gain code (G), indicating the selection results, to multiplexing section 414.

Multiplexing section 414 receives as input the code (L) representing the quantized LPC from LPC quantization section 403, and the code (A) representing the adaptive excitation vector, code (F) representing the fixed excitation vector, and code (G) representing the quantization gain from parameter determining section 413, and multiplexes and outputs these information as an encoded information for the base layer.

Figure 5:
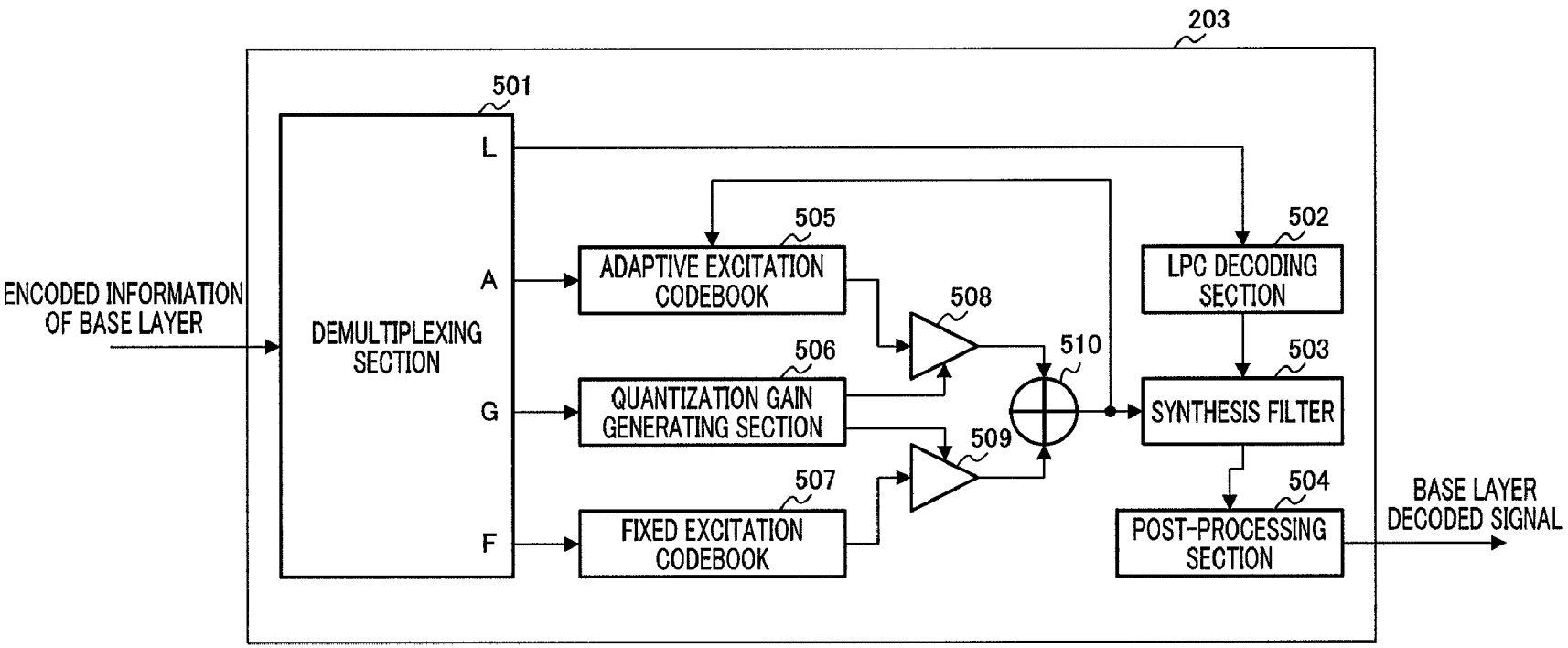
FIG. 5 is a block diagram showing an internal configuration of a base layer decoding section in a coding apparatus according to Embodiment 1 of the present invention.

Next, the internal configuration of base layer decoding apparatus 203 shown in FIG. 2 will be explained using FIG. 5. Demultiplexing section 501 demultiplexes the inputted encoded information for the base layer into individual codes (L, A, G, F). The LPC code (L) is outputted to LPC decoding section 502, the adaptive excitation vector code (A) is outputted to adaptive excitation codebook 505, the excitation gain code (G) is outputted to quantization gain generating section 506, and the fixed excitation vector code (F) is outputted to fixed excitation codebook 507.

Adaptive excitation codebook 505 extracts one frame of samples from the past excitations specified by the code (A) outputted from demultiplexing section 501 as an excitation vector, and outputs the result to multiplying section 508. Quantization gain generating section 506 decodes the quantized adaptive excitation gain and quantized fixed excitation gain specified by the excitation gain code (G) outputted from demultiplexing section 501, and outputs the results to multiplying section 508 and multiplying section 509. Fixed excitation codebook 507 generates the fixed excitation vector specified by the code (F) outputted from demultiplexing section 501, and outputs the results to multiplying section 509.

Multiplying section 508 multiplies the adaptive excitation vector by the quantized adaptive excitation gain, and outputs the result to adding section 510. Multiplying section 509 multiplies the fixed excitation vector by the quantized fixed excitation gain, and outputs the result to adding section 510. Adding section 510 generates excitation by adding the adaptive excitation vector and fixed excitation vector outputted from multiplication sections 508 and 509 after the gain multiplication, and outputs this excitation to synthesis filter 503 and adaptive excitation codebook 505.

LPC decoding section 502 decodes the quantized LPC from the code (L) outputted from demultiplexing section 501, and outputs the result to synthesis filter 503. Synthesis filter 503 performs filter synthesis with respect to the excitation outputted from adding section 510 using the filter coefficients decoded in LPC decoding section 502, and outputs the synthesis signal to post-processing section 504. Post-processing section 504 processes the signal outputted from synthesis filter 503 by performing processing that improves the subjective quality of speech, such as formant enhancement and pitch enhancement, and processing that improves the subjective quality of stationary noise, and outputs the result as a decoded signal for the base layer.

Figure 6:
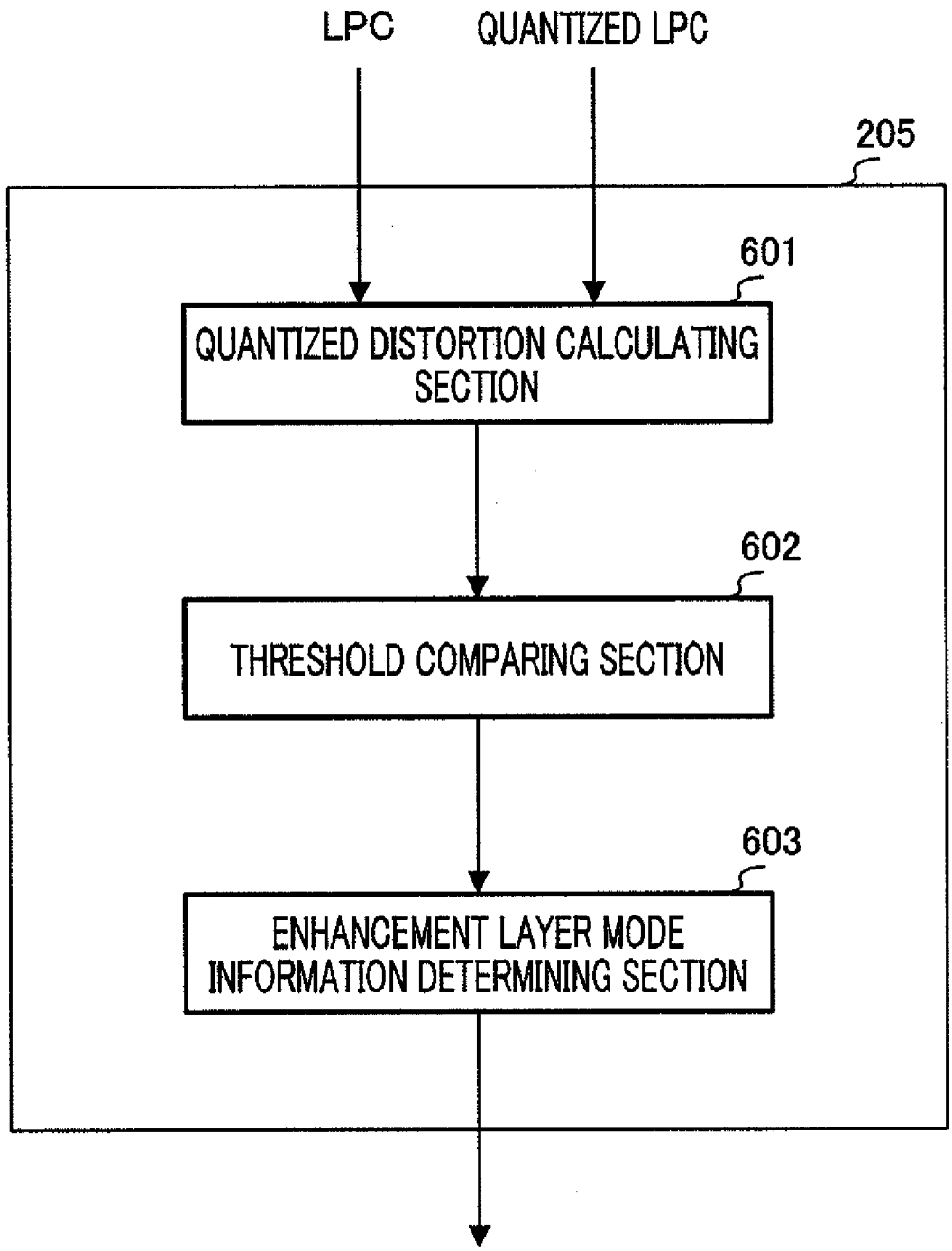
FIG. 6 is a block diagram showing an internal configuration of an enhancement layer control section in a coding apparatus according to Embodiment 1 of the present invention.

Next, the internal configuration of enhancement layer control section 205 shown in FIG. 2 and the control method of enhancement layer coding section 206 by enhancement layer control section 205 will be explained using FIG. 6. Enhancement layer control section 205 is configured mainly with quantized distortion calculating section 601, threshold comparing section 602 and enhancement layer mode information determining section 603.

First, quantized distortion calculating section 601 calculates an LPC cepstrum and a quantized LPC cepstrum from the inputted LPC and the inputted quantized LPC, respectively, using following equation 1. Here, in equation 1, "α" is the LPC (or quantized LPC) of P order inputted from base layer coding section 202 and "c" is the LPC cepstrum (or quantized LPC cepstrum).

(Equation 1)

$$c_n = \begin{cases} c_n = -\alpha_n & (n = 1) \\ c_n = -\alpha_n - \sum_{m=1}^{p}\left(1 - \frac{m}{n}\right)\alpha_m c_{n-m} & (1 < n \le p) \\ c_n = -\sum_{m-1}^{p}\left(1 - \frac{m}{n}\right)\alpha_m c_{n-m} & (p < n) \end{cases} \quad [1]$$

Next, quantized distortion calculating section 601 calculates the distance between the LPC cepstrum and the quantized LPC cepstrum calculated in above equation 1 (i.e., LPC cepstrum distance, "CD"), using following equations 2 and 3. The calculated LPC cepstrum distance is outputted to threshold comparing section 602. Here, in equation 2, $c^1$ is the LPC cepstrum and $c^2$ is the quantized LPC cepstrum.

(Equation 2)

$$D^2 = \sum_{i=1}^{p}(c_i^1 - c_i^2)^2 \quad [2]$$

(Equation 3)

$$CD = 10\log10 \cdot \sqrt{2 \cdot D^2} \quad [3]$$

Threshold comparing section 602 compares the LPC cepstrum distance outputted from quantized distortion calculating section 601 and a predetermined threshold held in threshold comparing section 602, and outputs the comparison result to enhancement layer mode information determining section 603. Further, when the order of the LPC is around 12, an adequate threshold would be around 1.0.

Enhancement layer mode information determining section 603 determines the coding mode of the enhancement layer according to the comparison result outputted from threshold comparing section 602 and outputs mode information of the enhancement layer showing the coding mode to enhancement layer coding section 206. To be more specific, when the comparison result shows that the LPC cepstrum distance is greater than the threshold, that is, when LPC quantization error is significant, enhancement layer mode information determining section 603 makes the coding mode of the enhancement layer Mode A. On the other hand, when the comparison result shows that the LPC cepstrum distance is equal to or less than the threshold, that is, when the LPC quantization error is insignificant, enhancement layer mode information determining section 603 makes the coding mode of the enhancement layer Mode B.

Figure 7:
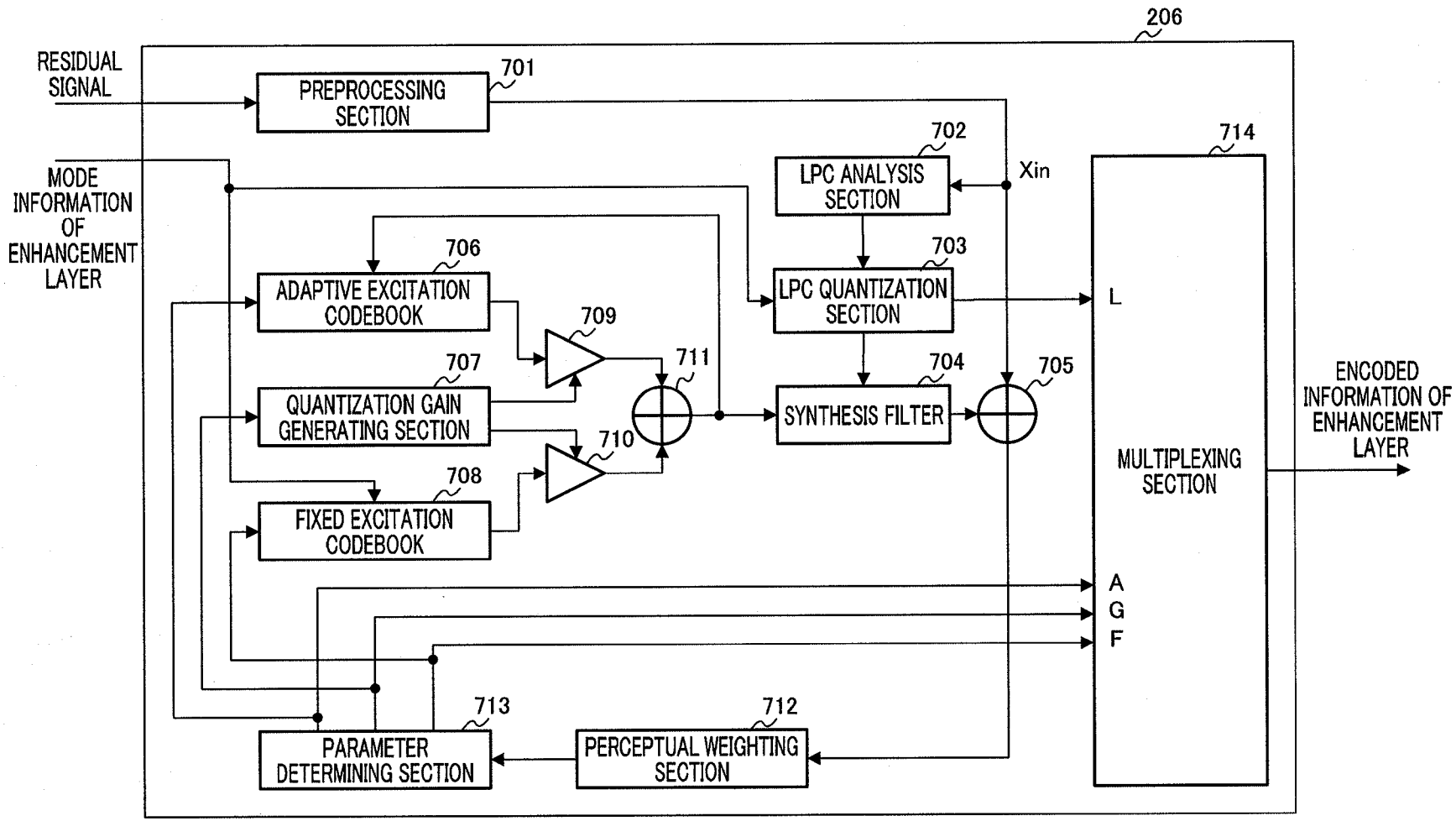
FIG. 7 is a block diagram showing an internal configuration of an enhancement layer coding section in a coding apparatus according to Embodiment 1 of the present invention.

Next, the internal configuration of enhancement layer coding section 206 shown in FIG. 2 will be explained using FIG. 7. Pre-processing section 701 processes the residual signal by performing highpass filter processing that removes the DC components, waveform shaping processing and preemphasis processing that leads to improved performance in subsequent coding processing, and outputs the signal (Xin) after these processing to LPC analysis section 702 and adding section 705.

LPC analysis section 702 performs linear predictive analysis using Xin, and outputs the LPC representing the analysis result to LPC quantization section 703. LPC quantization section 703 performs quantization processing for the LPC outputted from LPC analysis section 702 using the mode information of the enhancement layer outputted from enhancement layer control section 205 and outputs the quantized LPC to synthesis filter 704 and the code (L) representing the quantized LPC to multiplexing section 714. Here, LPC quantization section 703 switches the codebook (LPC codebook) to use for LPC quantization as appropriate, based on the enhancement layer mode information. To be more specific, when the enhancement layer mode information shows Mode A, that is, when the LPC quantization error is significant, LPC quantization section 703 performs quantization using a predetermined LPC codebook A. On the other hand, when the enhancement layer mode information shows Mode B, that is, when the LPC quantization error is insignificant, LPC quantization section 703 performs quantization using a predetermined LPC codebook B. Here, the size of LPC codebook B is smaller than that of LPC codebook A. Further, according to the present embodiment, it is possible to make the size of LPC codebook B zero, that is, it is possible not to use the LPC of the enhancement layer.

Synthesis filter 704 generates a synthesis signal by performing filter synthesis with respect to the excitation outputted from adding section 711, which is described later, using filter coefficients based on the quantized LPC, and outputs the synthesis signal to adding section 705. Adding section 705 calculates an error signal by inverting the polarity of the synthesis signal and adding the result to Xin, and outputs this error signal to perceptual weighting section 712.

Adaptive excitation codebook 706 that stores the excitations outputted in the past by adding section 711 in a buffer extracts one frame of samples from the past excitations specified by a signal to be outputted from parameter determining section 713 as an excitation vector, and outputs the result to multiplying section 709. Quantization gain generating section 707 outputs a quantized adaptive excitation gain and quantized fixed excitation gain specified by the signal outputted from parameter determining section 413 to multiplying section 409 and multiplying section 410, respectively.

Fixed excitation codebook group 708 has a plurality of fixed excitation codebooks and selects one of the fixed excitation codebooks according to the mode information of the enhancement layer outputted from enhancement layer control section 205. To be more specific, when the enhancement layer mode information shows Mode A, that is, when the LPC quantization error is significant, fixed excitation codebook group 708 selects the fixed excitation codebook A. On the other hand, when the enhancement layer mode information shows Mode B, that is, when the LPC quantization error is insignificant, fixed excitation codebook group 708 selects the fixed excitation codebook B. Here, in each frame, when the size difference (bit difference) between the fixed excitation codebook B and the fixed excitation codebook A is the same as the size difference between the LPC codebook A and the LPC codebook B, the bit rate to be used for coding using fixed excitation codebook A and the bit rate to be used for coding using fixed excitation codebook B are equivalent. This occurs in a case, for example, where, when a coding scheme is used whereby the LPC code is calculated on a per frame basis and the fixed excitation code every quarter of a frame, the size of the LPC codebook A is 256, the size of LPC codebook B is 16, the size of fixed excitation codebook A is 16 and the size of fixed excitation codebook B is 32.

Further, out of a plurality of pulse excitation vectors stored in the selected fixed excitation codebook, fixed excitation codebook group 708 selects the pulse excitation vector with the waveform specified by the signal outputted from parameter determining section 713 and outputs the pulse excitation vector to multiplying section 710. Further, fixed excitation codebook group 708 may generate a fixed excitation vector by multiplying the selected pulse excitation vector by a spreading vector, and output this fixed excitation vector to multiplying section 710.

Multiplication section 709 multiplies the adaptive excitation vector outputted from adaptive excitation codebook 706 by the quantized adaptive excitation gain outputted from quantization gain generating section 707, and outputs the result to adding section 711. Multiplying section 710 multiplies the fixed excitation vector outputted from fixed excitation codebook group 708 by the quantized fixed excitation gain outputted from quantization gain generating section 707, and outputs the result to adding section 711. Adding section 711 adds the adaptive excitation vector and fixed excitation vector after gain multiplication and outputs the excitation representing the addition result to synthesis filter 704 and adaptive excitation codebook 706. Further, the excitation inputted to adaptive excitation codebook 706 is stored in a buffer.

Perceptual weighting section 712 performs perceptual weighting for the error signal outputted from adding section 705 and outputs the result to parameter determining section 713 as coding distortion. Parameter determining section 713 selects the adaptive excitation vector, fixed excitation vector, and quantization gain that minimize the coding distortion outputted from perceptual weighting section 712, from adaptive excitation codebook 706, fixed excitation codebook group 708, and quantization gain generating section 707, respectively, and outputs the adaptive excitation vector code (A), fixed excitation vector code (F), and excitation gain code (G), indicating the selection results, to multiplexing section 714.

Multiplexing section 714 receives as input, the code (L) representing the quantized LPC from LPC quantization section 703, and the code (A) representing the adaptive excitation vector, code (F) representing the fixed excitation vector, and code (G) representing the quantization gain from parameter determining section 413, and multiplexes and outputs these information as an encoded information for the enhancement layer.

Figure 8:
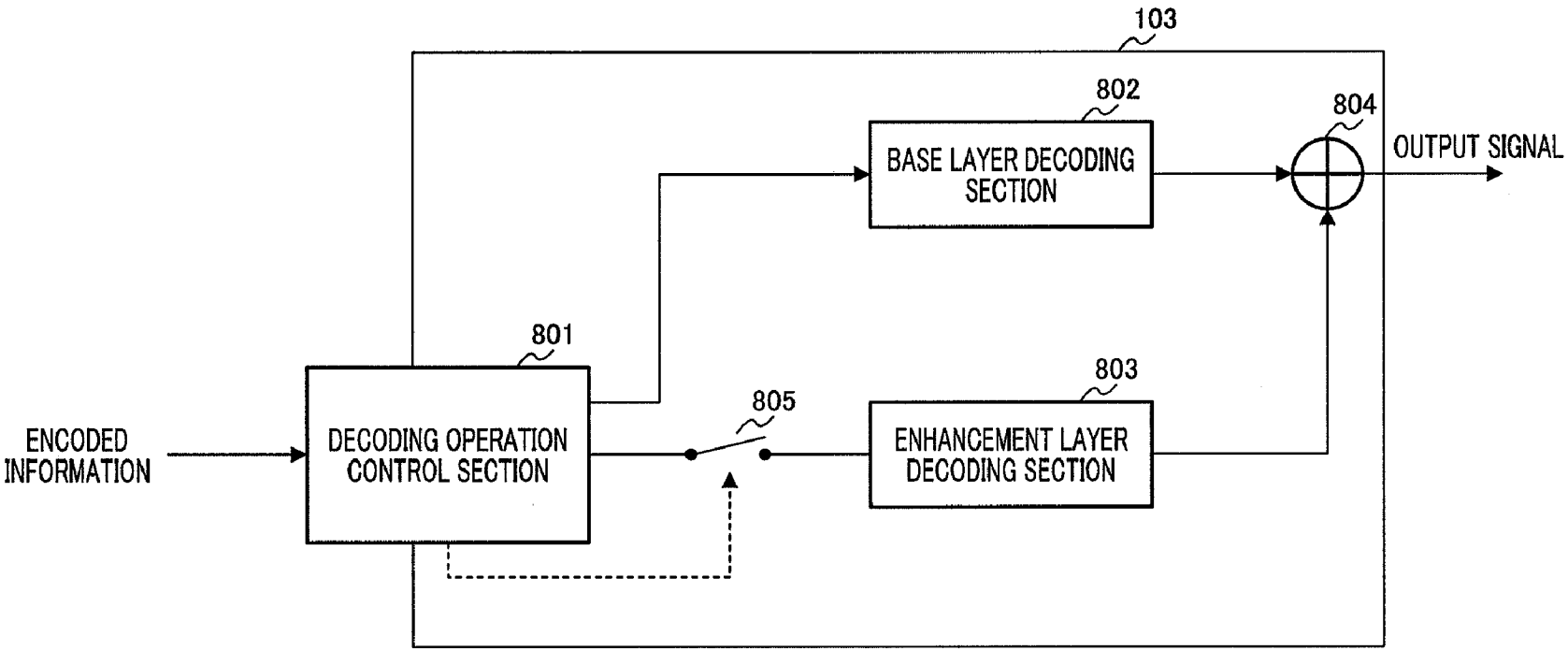
FIG. 8 is a block diagram showing a decoding apparatus according to Embodiment 1 of the present invention.

Next, the internal configuration of decoding section 103 shown in FIG. 2 will be explained using FIG. 8. Decoding apparatus 103 is configured mainly with decoding operation control section 801, base layer decoding section 802, enhancement layer decoding section 803, adding section 804 and control switch 805.

Decoding operation control section 801 receives as input, encoded information transmitted from coding apparatus 101 via channel 102. Decoding operation control section 801 demultiplexes the encoded information into the transmission mode information, the mode information of the enhancement layer, and the encoded information of individual layers, and performs the on/off control of control switch 805 according to the transmission mode information. Further, decoding operation control section 801 outputs the encoded information of the layers and the enhancement layer mode information to base layer decoding section 802 and enhancement layer decoding section 803, respectively. To be more specific, when the transmission mode information shows BR2, decoding operation control section 801 makes control switch 805 on, outputs the encoded information for the base layer to base layer decoding section 802 and outputs the mode information of the enhancement layer and the enhancement layer encoded information to enhancement layer decoding section 803. Further, when the transmission mode information shows BR1, decoding operation control section 801 makes control switch 805 off and outputs the base layer encoded information to base station layer decoding section 802. Further, in this case, decoding operation control section 801 outputs nothing to enhancement layer decoding section 803.

Base layer decoding section 802 receives as input the encoded information for the base layer from decoding operation control section 801, decodes this using a CELP type speech coding method and outputs the decoded signal to adding section 804 as the decoded signal for the base layer. Further, the internal configuration of base layer decoding section 802 shown in FIG. 8 is the same as in base layer decoding section 203 shown in FIG. 5.

When control switch 805 is on, enhancement layer decoding section 803 receives as input the mode information of the enhancement layer and encoded information of the enhancement layer form decoding operation control section 801, decodes the enhancement layer encoded information using a CELP type speech decoding method according to the enhancement layer mode information, and adds the decoded signal to adding section 804 as a decoded signal for the enhancement layer. On the other hand, when control switch is off, enhancement layer decoding section 803 does not operate. Further, the configuration of enhancement layer decoding section 803 will be described later.

When control switch 805 is on, adding section 804 receives as input the decoded signal for the base layer from base layer decoding section 802 and the decoded signal for the enhancement layer from enhancement layer decoding section 803, adds these signals and outputs the result to the apparatus in the subsequent step as an output signal. On the other hand, when control switch 805 is off, adding section 804 receives as input the decoded signal for the base layer from base layer decoding section 802 and outputs the base layer decoded signal as an output signal to the apparatus in the subsequent step.

Figure 9:
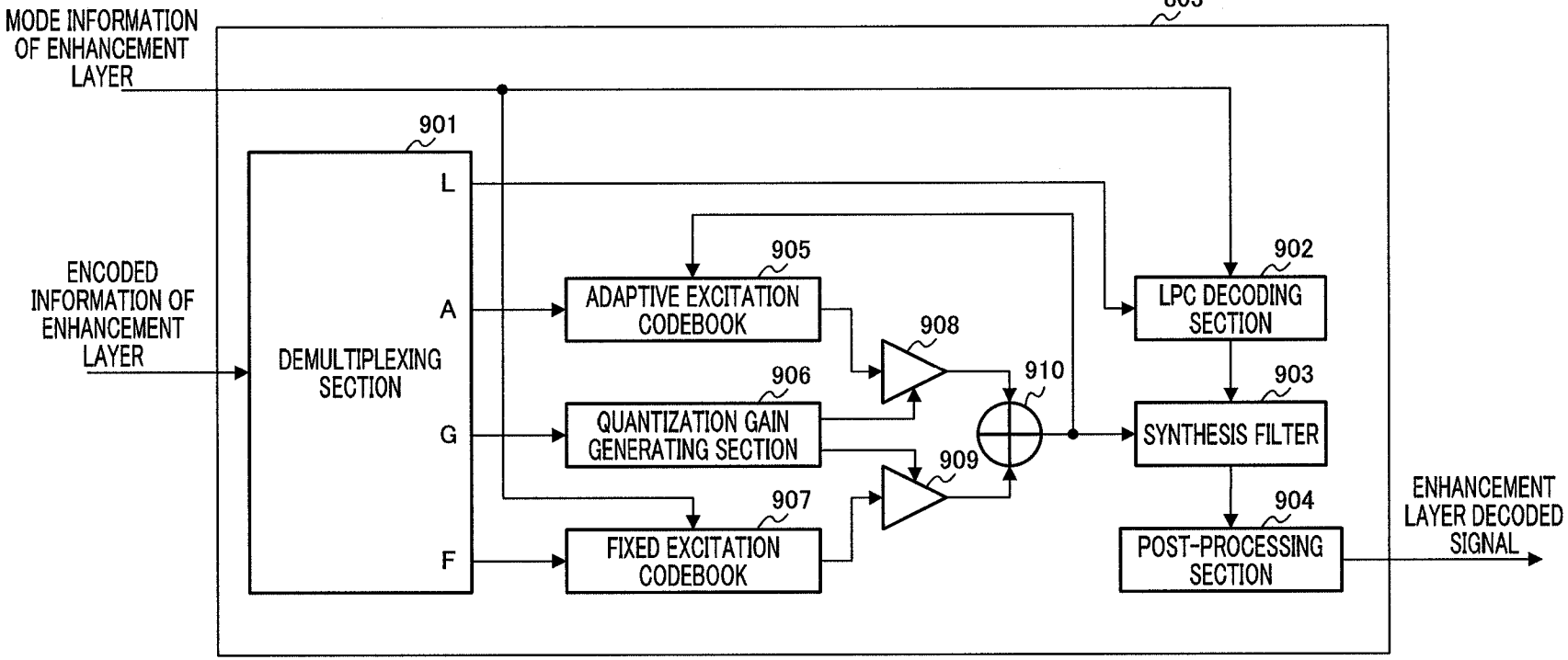
FIG. 9 is a block diagram showing an internal configuration of an enhancement layer decoding section in a decoding apparatus according to Embodiment 1 of the present invention.

Next, the internal configuration of enhancement layer decoding section 803 of FIG. 8 will be explained using FIG. 9. In FIG. 9, demultiplexing section 901 demultiplexes the encoded information for the enhancement layer inputted from decoding operation control section 801 into individual codes (L, A, G, F). The LPC code (L) is outputted to LPC decoding section 902, the adaptive excitation vector code (A) is outputted to adaptive excitation codebook 905, the excitation gain code (G) is outputted to quantization gain generating section 906, and the fixed excitation vector code (F) is outputted to fixed excitation codebook group 907.

LPC decoding section 902 decodes the quantized LPC from the code (L) outputted from demultiplexing section 901 using the mode information of the enhancement layer outputted from decoding operation control section 801 and outputs the quantized LPC's to synthesis filter 903. Here, LPC decoding section 902 switches a codebook (LPC codebook) to be used for LPC quantization as appropriate, based on the enhancement layer mode information. To be more specific, when the enhancement layer mode information shows Mode A, LPC quantization section 703 performs decoding using a predetermined LPC codebook A, and, when the enhancement layer mode information shows Mode B, performs decoding using a predetermined LPC codebook B. Here, the size of LPC codebook B is smaller than LPC codebook A. Further, according to the present embodiment, it is possible to make the size of LPC codebook B zero, that is, it is possible not to use the LPC of the enhancement layer.

Adaptive excitation codebook 905 extracts one frame of samples from the past excitations specified by the code (A) outputted from demultiplexing section 901 as an excitation vector, and outputs the result to multiplying section 908. Quantization gain generating section 906 decodes the quantized adaptive excitation gain and the quantized fixed excitation gain specified by the excitation gain code (G) outputted from demultiplexing section 901, and outputs the results to multiplying section 908 and multiplying section 909.

Fixed excitation codebook group 907 has a plurality of fixed excitation codebooks and selects one of the fixed excitation codebooks according to the mode information of the enhancement layer outputted from decoding operation control section 801. To be more specific, when the enhancement layer mode information shows Mode A, fixed excitation codebook group 907 selects fixed excitation codebook A, and, when the enhancement layer mode information shows Mode B, selects fixed excitation codebook B. Further, out of a plurality of pulse excitation vectors stored in the selected fixed excitation codebook, fixed excitation codebook group 907 selects a pulse excitation vector with the waveform specified by the code (F) outputted from demultiplexing section 901 and outputs the pulse excitation vector to multiplying section 909. Further, fixed excitation codebook group 907 may generate a fixed excitation vector by multiplying the selected pulse excitation vector by a spreading vector, and output the fixed excitation vector to multiplying section 909.

Multiplying section 908 multiplies the adaptive excitation vector by the quantized adaptive excitation gain, and outputs the result to adding section 910. Multiplying section 909 multiplies the fixed excitation vector by the quantized fixed excitation gain, and outputs the result to adding section 910. Adding section 910 adds the adaptive excitation vector and fixed excitation vector outputted from multiplying sections 908 and 909 after the gain multiplication, and outputs the excitation representing the addition result to synthesis filter 903 and adaptive excitation codebook 905.

Synthesis filter 903 performs filter synthesis with respect to the excitation outputted from adding section 910 using the filter coefficient decoded by LPC decoding section 502, and outputs the synthesis signal to post-processing section 904. Post-processing section 904 processes the signal outputted from synthesis filter 903 by performing processing that improves the subjective quality of the speech, such as formant enhancement and pitch enhancement, and processing that improves the subjective quality of stationary noise, and outputs the result as a decoded signal for the enhancement layer.

As described above, according to the present embodiment, with a coding apparatus that performs coding using a scalable coding technique, it is possible to flexibly change the coding method for a higher layer (for example, change the bit allocation between parameters such as the LPC and fixed excitation code) based on the coding result in a lower layer, thereby making possible a communication system where signals of good quality are provided to the user taking into account the coding result in a lower layer.

Further, although a case has been described above with the present embodiment where the coding apparatus utilizes the LPC distortion (i.e., LPC cepstrum distance) of a lower layer to reduce the number of bits to be assigned to the LPC upon coding a higher layer by using a small-sized LPC codebook and increase the number of bits to be assigned to the fixed excitation code using a large-sized fixed excitation codebook, the present invention is not limited to this and is also applicable to cases where a large-sized LPC codebook and a small-sized fixed excitation codebook are used upon coding of a higher layer.

Further, although an example case has been described above with the present embodiment where the coding apparatus controls the coding mode of a higher layer based on LPC quantization error in a lower layer, the present invention is not limited to this and it is equally possible to control the coding mode of a higher layer based other lower layer parameters. An example case will be explained below where the coding mode in the higher layer is controlled based on the SNR (Signal to Noise Ratio) of the synthesis signal in the lower layer. In this case, the SNR of a synthesis signal synthesized from the LPC quantized coefficients outputted from LPC quantization section 403 and the value multiplying the adaptive excitation code outputted from adaptive excitation codebook 406 by a gain, is calculated in synthesis filter 404 of base layer coding section 202 and outputted to threshold comparing section 602 in enhancement layer control section 205. Threshold comparing section 602 compares the inputted SNR and a threshold stored in advance, and outputs the comparison result to enhancement layer mode information determining section 603. Enhancement layer mode information determining section 603 determines mode information of the enhancement layer according to the comparison result outputted from threshold comparing section 602 and outputs the enhancement layer mode information to enhancement layer coding section 206. To be more specific, when the SNR outputted from base layer coding section 202 is greater than the threshold, enhancement layer mode information determining section 603 makes the enhancement layer mode Mode A, and, when the SNR outputted from base layer coding section 202 is equal to or less than the threshold, makes the enhancement layer mode Mode B.

Further, by combining the above enhancement layer control method using the LPC cepstrum distance and the enhancement layer control method using the SNR of a synthesis signal synthesized from an adaptive excitation code multiplied by a gain and LPC coefficient, it is possible to perform bit adjustment between three parameters comprised of the LPC, adaptive excitation code and fixed excitation code.

Embodiment 2

Although a case has been described with above Embodiment 1 where a CELP type coding method is used in the lower layer and higher layer in a scalable coding method, the present invention is not limited to this and is also applicable to a scalable coding method using another coding method in the higher layer instead of the CELP type coding method. A case will be explained with Embodiment 2 where the present invention is applied to a scalable coding method in which CELP type coding is performed in the lower layer and transform coding is performed in the higher layer. A communication system having the coding apparatus and decoding apparatus according to the present invention is the same as in FIG. 1 and explanations thereof will be omitted.

Figure 10:
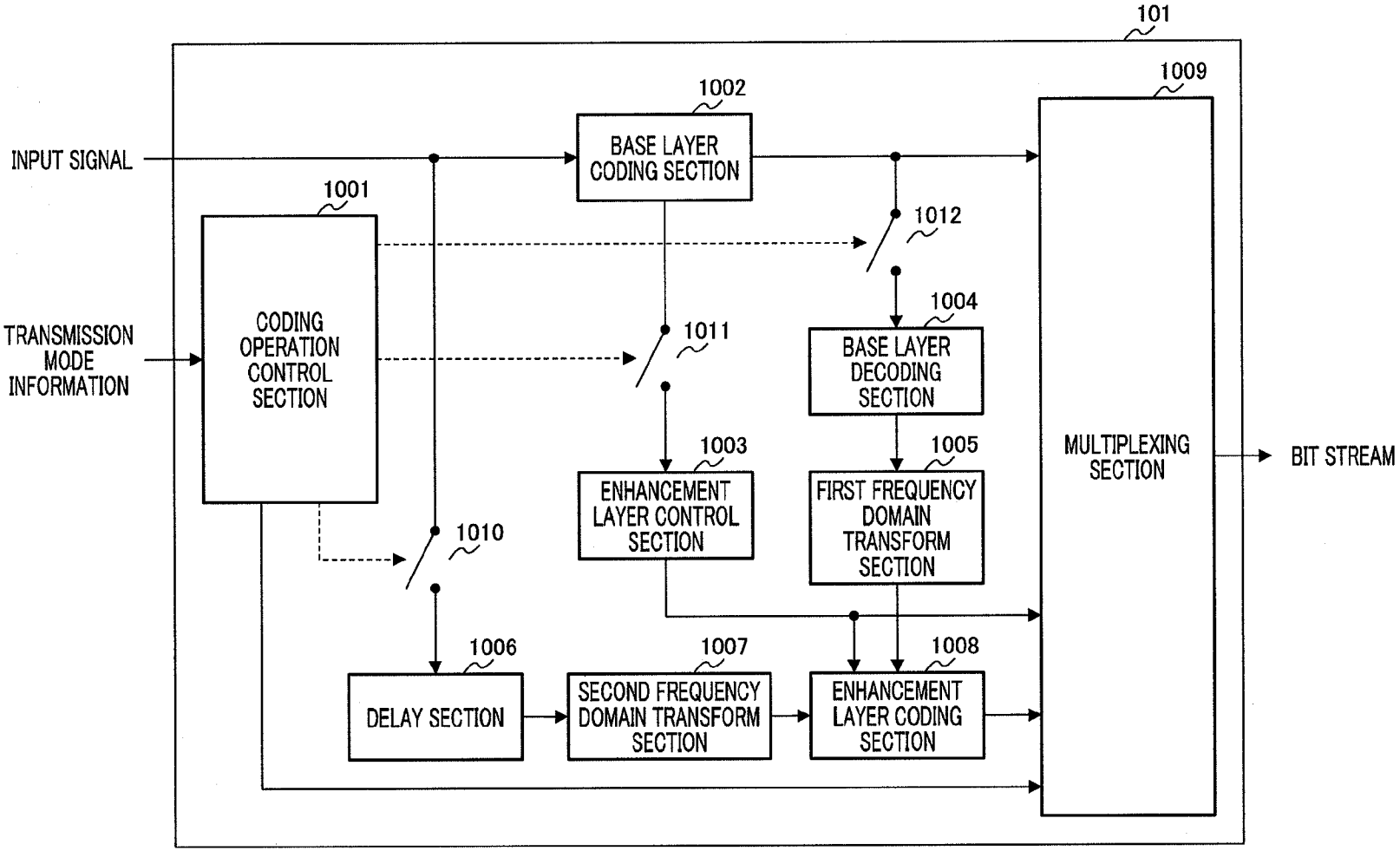
FIG. 10 is a block diagram showing a configuration of a coding apparatus according to Embodiment 2 of the present invention.

FIG. 10 is a block diagram showing the configuration of coding apparatus 101 according to the present embodiment. As shown in FIG. 10, coding apparatus 101 is configured mainly with coding operation control section 1001, base layer coding apparatus 1002, enhancement layer control section 1003, base layer decoding section 1004, first frequency domain transform section 1005, delay section 1006, second frequency domain transform section 1007, enhancement layer coding section 1008 and multiplexing section 1009.

Coding operation control section 1001 receives as input transmission mode information. Coding operation control section 1001 performs the on/off control of control switches 1010 to 1012 according to the inputted transmission mode information. To be more specific, when the transmission mode information shows BR2, coding operation control section 1001 makes control switches 1010 to 1012 all on. When the transmission mode information shows BR1, coding operation control section 1001 makes control switches 1010 to 1012 all off. Further, the transmission mode information is inputted to coding operation control section 1001 as above and also inputted to multiplexing section 1009 through coding operation control section 1001 as shown in FIG. 10 or directly inputted to multiplexing section 1009 without passing coding operation control section 1001. Thus, coding operation control section 1001 performs the on/off control of a control switch group according to transmission mode information, thereby determining the combination of coding sections for use to encode an input signal.

Base layer coding section 1002 generates an encoded information for the base layer by encoding the input signal of an speech signal or the like using a CELP type speech coding method, and outputs the generated base layer encoded information to multiplexing section 1009 and control switch 1012. Further, base layer coding section 1002 outputs the LPC (Linear Prediction Coefficients) and quantized LPC, which are parameters calculated upon speech-coding the input signal, to control switch 1011. The internal configuration of base layer coding section 1002 is the same as in base layer coding section 202 shown in FIG. 4 and explanations thereof will be omitted.

When control switch 1011 is on, enhancement layer control section 1003 generates base layer mode information based on the LPC and quantized LPC outputted from base layer coding section 1002, and outputs the mode information of the enhancement layer to enhancement layer coding section 1008 and multiplexing section 1009. The enhancement layer mode information refers to information showing the coding mode of the enhancement layer, and is used to decode the encoded information of the enhancement layer in the decoding apparatus. Further, the internal configuration of enhancement layer control section 1003 will be described later. Further, when control switch 1011 is off, enhancement layer control section 1003 does not operate.

When control switch 1004 is on, base layer decoding section 1004 generates the decoded signal for the base layer by decoding the base layer encoded information outputted from base layer coding section 1002 using a CELP type speech decoding method, and outputs the generated base layer decoded signal to first frequency domain transform section 1005. On the other hand, when control switch 1012 is off, base layer decoding section 1004 does not operate. The internal configuration of base layer decoding section 1004 is the same as in decoding section 203 in FIG. 5 and explanations thereof will be omitted.

First frequency domain transform section 1005 performs a modified discrete cosine transform (MDCT) for the decoded signal for the base layer inputted from base layer decoding section 1004, and outputs the base layer decoded MDCT coefficient acquired as a frequency domain parameter, to enhancement layer coding section 1008.

First frequency domain transform section 1005 includes N buffers, and, first, initializes these buffers using "0" according to following equation 4. Further, in equation 4, $buf_n$ (n=0, . . . , N−1) shows the (n+1)-th buffer among N buffers included in first frequency domain transform section 1005.

[4]

$$buf_n=0\ (n=0,\ldots,N-1) \qquad \text{(Equation 4)}$$

Next, according to the following equation 5, first frequency domain transform section 1005 finds base layer decoded MDCT coefficient $X1_k$ by performing a modified discrete cosine transform for base layer decoded signal $X1_n$. In equation 5, k is the index of each sample in a frame. Further, $x1'_n$ is the vector combining decoded signal for the base layer $x1_n$ and buffer $buf_n$ according to following equation 6.

(Equation 5)

$$X1_k = \frac{2}{N}\sum_{n=0}^{2N-1} x1'_n \cos\left[\frac{(2n+1+N)(2k+1)\pi}{4N}\right] \quad (k=0,\ldots,N-1) \qquad [5]$$

(Equation 6)

$$x1'_n = \begin{cases} buf_n & (n=0,\ldots N-1) \\ x1_{n-N} & (n=N,\ldots 2N-1) \end{cases} \qquad [6]$$

Next, first frequency domain transform section 1005 updates buffer $buf_n$ (n=0, . . . , N−1) as shown in following equation 7.

[7]

$$buf_n = x1_n \ (n=0, \ldots N-1) \quad \text{(Equation 7)}$$

Next, first frequency domain transform section 1005 outputs the found decoded MDCT coefficient $X1_k$ to enhancement layer coding section 1008.

When control switch 1010 is on, delay section 1006 stores the inputted speech/audio signal in an inner buffer and outputs the speech/audio signal to second frequency domain transform section 1007 after a predetermined period. Here, the predetermined period refers to a period based on algorithm delays that occur in base layer coding section 1002, base layer decoding section 1004, first frequency domain transform section 1005 and second frequency domain transform section 1007. Further, when control switch 1010 is off, delay section 1006 does not operate.

When control switch 1010 is on, second frequency domain transform section 1007 performs a modified discrete cosine transform for the speech/audio signal inputted from delay section 1006 and outputs the input MDCT coefficient acquired as a frequency domain parameter to enhancement layer coding section 1008. Here, the frequency transform method in second frequency domain transform section 1007 is the same as in first frequency domain transform section 1005 and explanations thereof will be omitted. Further, when control switch 1010 is off, second frequency domain transform section 1007 does not operate.

When control switches 1010, 1011 and 1012 are on, enhancement layer coding section 1008 performs enhancement layer coding using the mode information of the enhancement layer inputted from enhancement layer control section 1003, the decoded MDCT coefficient in the base layer inputted from first frequency domain transform section 1005 and the input MDCT coefficient inputted from second frequency domain transform section 1007, and outputs the acquired enhancement layer encoded information to multiplexing section 1009. The internal configuration and detailed operations of enhancement layer coding section 1008 will be described later. Further, when control switches 1010, 1011 and 1012 are off, enhancement layer coding section 1008 does not operate.

Multiplexing section multiplexes the base layer encoded information inputted from base layer coding section 1002, the mode information of the enhancement layer inputted from enhancement layer control section 1003, the enhancement layer encoded information inputted from enhancement layer coding section 1008 and the transmission mode information inputted from coding operation control section 1001, and outputs the acquired bit stream to the decoding apparatus.

Here, the data structure (bit stream) of the transmission encoded information is the same as in Embodiment 1 and explanations thereof will be omitted.

Figure 11:
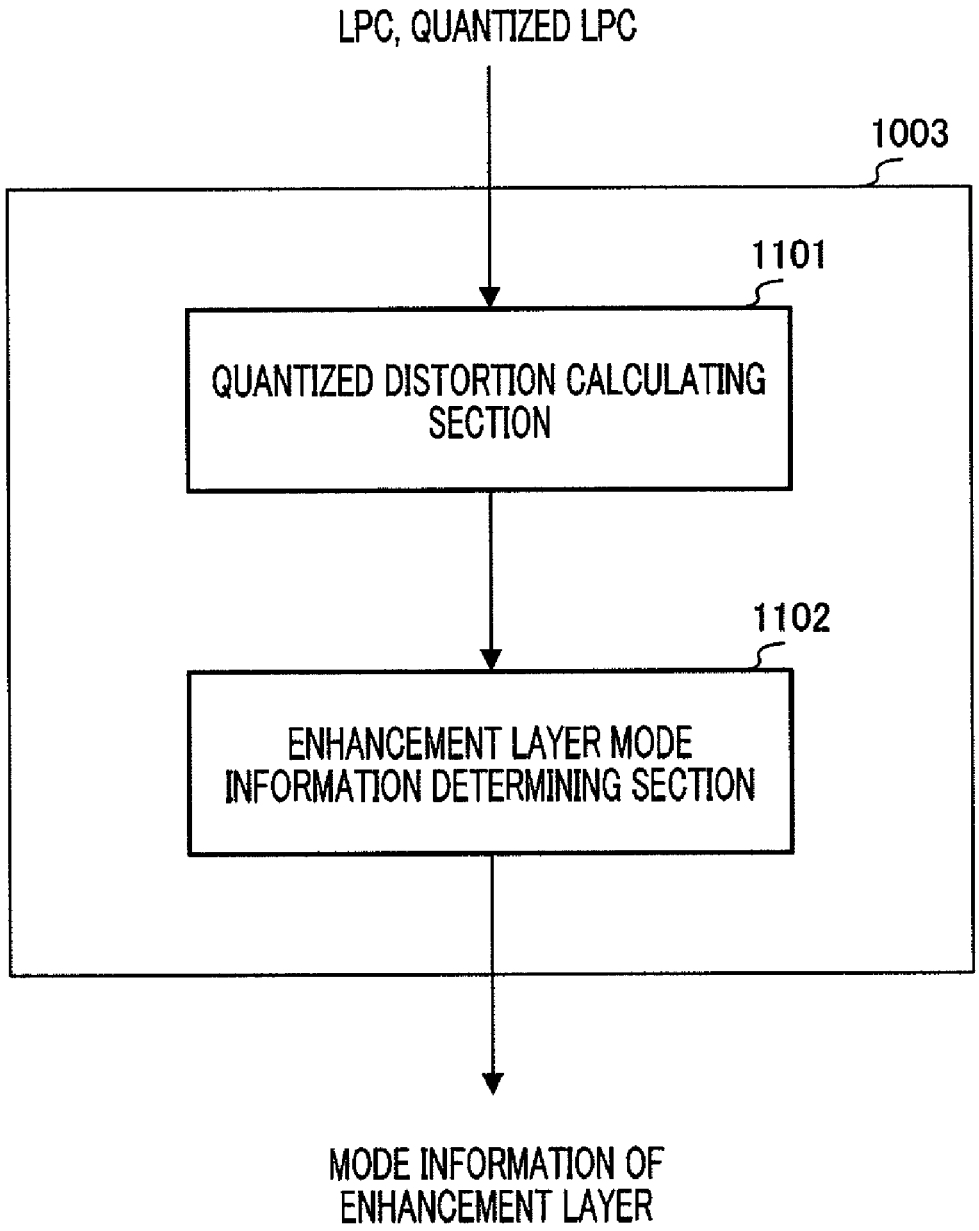
FIG. 11 is a block diagram showing an internal configuration of an enhancement layer control section in a coding apparatus according to Embodiment 2 of the present invention.

Next, the internal configuration of enhancement layer control section 1003 in FIG. 10 will be explained using FIG. 11. Enhancement layer control section 1003 is configured mainly with quantized distortion calculating section 1101 and enhancement layer mode information determining section 1102.

First, quantized distortion calculating section 1101 calculates an LPC cepstrum and a quantized LPC cepstrum from the inputted LPC and the inputted quantized LPC, respectively, using above equation 1, calculates the distance between the LPC cepstrum and quantized LPC cepstrum calculated in above equation 1 (i.e., LPC cepstrum distance, "CD"), using above equations 2 and 3, and outputs the calculated LPC cepstrum distance to enhancement layer mode information determining section 1102.

Enhancement layer mode information determining section 1102 compares the LPC cepstrum distance outputted from quantized distortion calculating section 1101 and a predetermined threshold held in enhancement layer mode information determining section 1102, determines the coding mode of the enhancement layer according to the comparison result, and outputs the mode information of the enhancement layer showing the coding mode to enhancement layer coding section 1108. To be more specific, when the comparison result shows that the LPC cepstrum distance is greater than the threshold, that is, when LPC quantization error is significant, enhancement layer mode information determining section 1102 makes the coding mode of the enhancement layer Mode A. On the other hand, when the comparison result shows that the LPC cepstrum distance is equal to or less than the threshold, that is, when the LPC quantization error is insignificant, enhancement layer mode information determining section 1102 makes the coding mode of the enhancement layer Mode B. Here, when the order of the LPC is around 12, an adequate threshold would be around 1.0.

Figure 12:
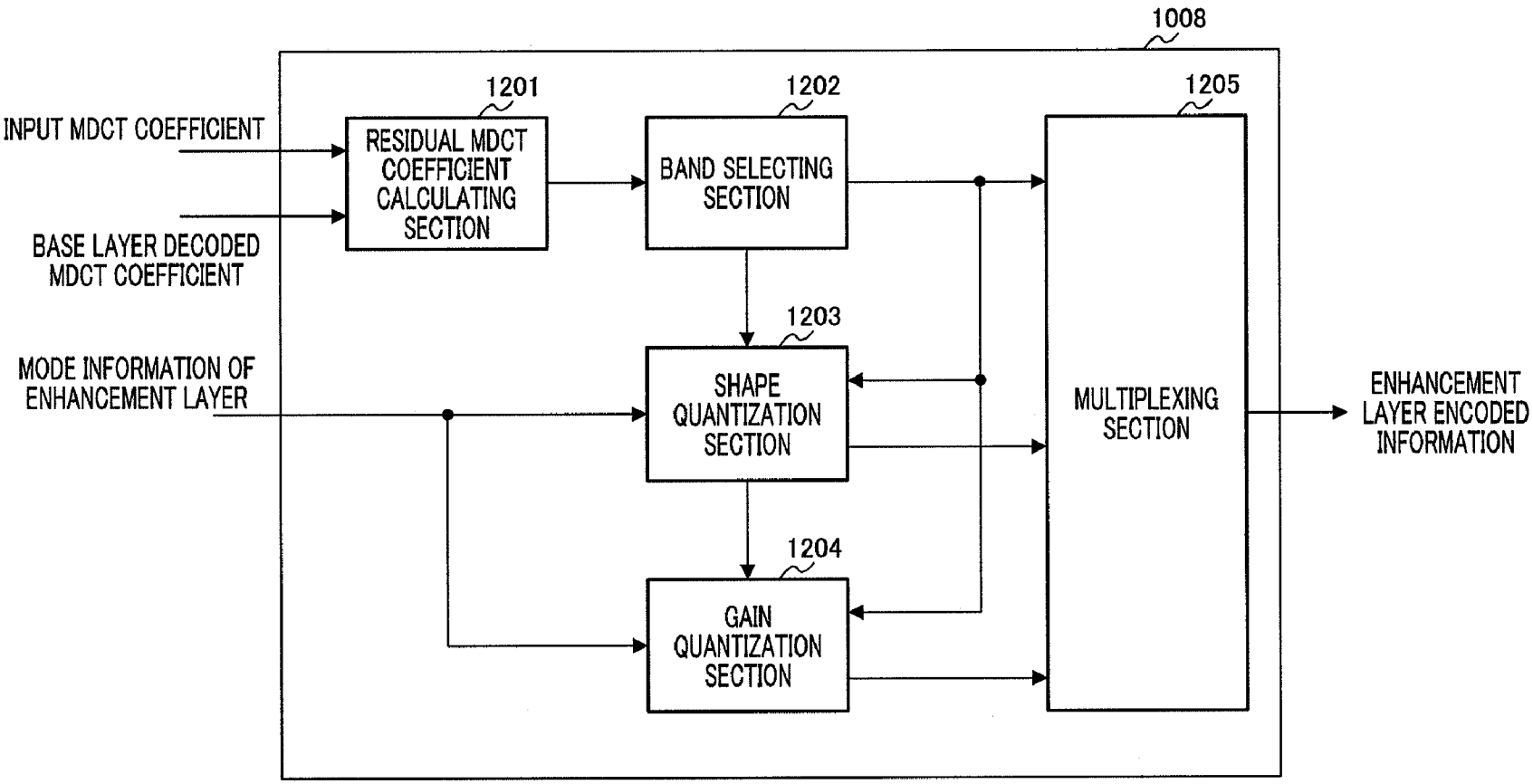
FIG. 12 is a block diagram showing an internal configuration of an enhancement layer coding section in a coding apparatus according to Embodiment 2 of the present invention.

Next, the internal configuration of enhancement layer coding section 1008 in FIG. 10 will be explained using FIG. 12. Enhancement layer coding section 1008 is configured mainly with residual MDCT coefficient calculating section 1202, band selecting section 1202, shape quantization section 1203, gain quantization section 1204 and multiplexing section 1205.

Residual MDCT coefficient calculating section 1201 finds the residue between the base layer decoded MDCT coefficient $X1_k$ inputted from first frequency domain transform section 1005 and the input MDCT coefficient $X_k$ inputted from second frequency domain transform section 1007, and outputs the result to band selecting section 1202 as residual MDCT coefficient $X2_k$.

First, band selecting section 1202 divides the residual MDCT coefficient into a plurality of subbands. Here, a case will be explained where the MDCT coefficient is equally divided into J subbands (J is a natural number). Band selecting section 1202 selects L (L is a natural number) consecutive subbands out of J subbands, and acquires M (M is a natural number) kinds of subband groups. These M kinds of subband groups will be referred to as "regions" in the following explanation.

Next, band selecting section 1202 calculates the average energy E(m) for each of M regions according to following equation 8.

(Equation 8)

$$E(m) = \frac{\sum_{j=S(m)}^{S(m)+L} \sum_{k=B(j)}^{B(j)+W(j)} (X2_k)^2}{L} \quad (m = 0, \ldots, M-1) \quad [8]$$

In this equation, j is the individual indexes for each of J subbands, and m is the index for each of M regions. Here, S(m) is the minimum value amongest the indexes for L subbands forming region m, B(j) is the minimum value amongest the indexes for multiple MDCT coefficients forming subband j, and W(j) is the bandwidth of subband j. An example case will be explained where J subbands all have the same bandwidth, that is, where W(j) is a fixed number.

Next, band selecting section 1202 selects a region in which average energy E(m) is maximum such as a band comprised of subbands j to j+L−1, as a band to be quantized (quantization target band), and outputs index m_max showing this region to shape quantization section 1203, gain quantization section 1204 and multiplexing section 1205 as band information. Further, band selecting section 1202 outputs the residual MDCT coefficient to shape quantization section 1203. Here, the residual MDCT coefficient is inputted to band selecting section 1202 as above, and also inputted to shape quantization section 1203 through band selecting section 1202 or directly inputted to shape quantization section 1203 without passing band selecting section 1202.

Shape quantization section 1203 performs shape quantization on a per subband basis, for a residual MCDT coefficient associated with a band shown by band information m_max inputted from band selecting section 1202, using the mode information of the enhancement layer inputted from enhancement layer control section 1003. To be more specific, when the mode information of the enhancement layer represents Mode A, shape quantization section 1203 searches an inner shape codebook comprised of SQA shape vectors in each of L subbands, and finds the index of the shape code vector that maximizes the result of following equation 9.

(Equation 9)

$$\text{Shape_q}(i) = \frac{\left\{\sum_{k=0}^{W(j)} (X2_{k+B(j)} \cdot SC_k^i)\right\}^2}{\sum_{k=0}^{W(j)} SC_k^i \cdot SC_k^i} \quad [9]$$

$$(j = j'', \ldots, j'' + L - 1,\ i = 0, \ldots, SQA - 1)$$

In this equation 9, SC is the shape code vector k forming a shape codebook, i is the index of the shape code vector and k is the index of an element of the shape code vector.

Further, when the mode information of the enhancement layer represents Mode B, shape quantization section 1203 searches an inner shape codebook comprised of SQB (SQB<SQA) shape vectors in each of L subbands, and finds the index of the shape code vector that maximizes the result of following equation 10.

(Equation 10)

$$\text{Shape_q}(i) = \frac{\left\{\sum_{k=0}^{W(j)} (X2_{k+B(j)} \cdot SC_k^i)\right\}^2}{\sum_{k=0}^{W(j)} SC_k^i \cdot SC_k^i} \quad [10]$$

$$(j = j'', \ldots, j'' + L - 1,\ i = 0, \ldots, SQB - 1)$$

Shape quantization section 1203 outputs to multiplexing section 1205, the index of shape code vector S_max that maximizes the result of above equation 9 or equation 10, as shape code information. Further, shape quantization section 1203 calculates ideal gain value Gain_i(j) according to following equation 11 and outputs the result to gain quantization section 1204.

(Equation 11)

$$\text{Gain_i}(j) = \frac{\sum_{k=0}^{W(j)} \left(X2_{k+B(j)} \cdot SC_k^{S_max}\right)}{\sum_{k=0}^{W(j)} SC_{k+B(j)}^{S_max} \cdot SC_{k+B(j)}^{S_max}} \quad [11]$$

$$(j = j'', \ldots, j'' + L - 1)$$

Gain quantization section 1204 performs vector quantization for ideal gain value Gain_i(j) inputted from shape quantization section 1203 using the mode information of the enhancement layer inputted from enhancement layer control section 1003. To be more specific, when the enhancement layer mode information shows Mode A, gain quantization section 1204 uses an ideal gain value as an L-dimension vector, and searches an inner gain codebook comprised of GQA gain code vectors and finds the index of the code book that minimizes the result of following equation 12. Here, the index of the codebook that minimizes the result of equation 12 is G_min.

(Equation 12)

$$\text{Gain_q}(i) = \sum_{j=0}^{L-1} \{\text{Gain_i}(j + j'') - GC_j^i\} \quad [12]$$

$$(i = 0, \ldots, GQA - 1)$$

Further, when the mode information of the enhancement layer represents Mode B, gain quantization section 1204 uses an ideal gain value as an L-dimension vector, and searches an inner gain codebook comprised of GQB (GQB<GQA) gain code vectors and finds the index of the code book that minimizes the result of following equation 13.

(Equation 13)

$$\text{Gain_q}(i) = \sum_{j=0}^{L-1} \{\text{Gain_i}(j + j'') - GC_j^i\} \quad [13]$$

$$(i = 0, \ldots, GQB - 1)$$

Gain quantization section 1204 outputs index G_min of the gain code vector that minimizes the result of equation 12 or equation 13 to multiplexing section 1205 as gain encoded information.

Multiplexing section 1205 multiplexes the band information m_max inputted from band selecting section 1202, the shape encoded information S_max inputted from shape quantization section 1203 and the gain encoded information G_min inputted from gain quantization section 1204, and outputs the acquired bit stream to multiplexing section 1009 as enhancement layer encoded information. Here, these items of information may not be multiplexed in multiplexing section 1205 and may be directly inputted to and multiplexed in multiplexing section 1009.

Figure 13:
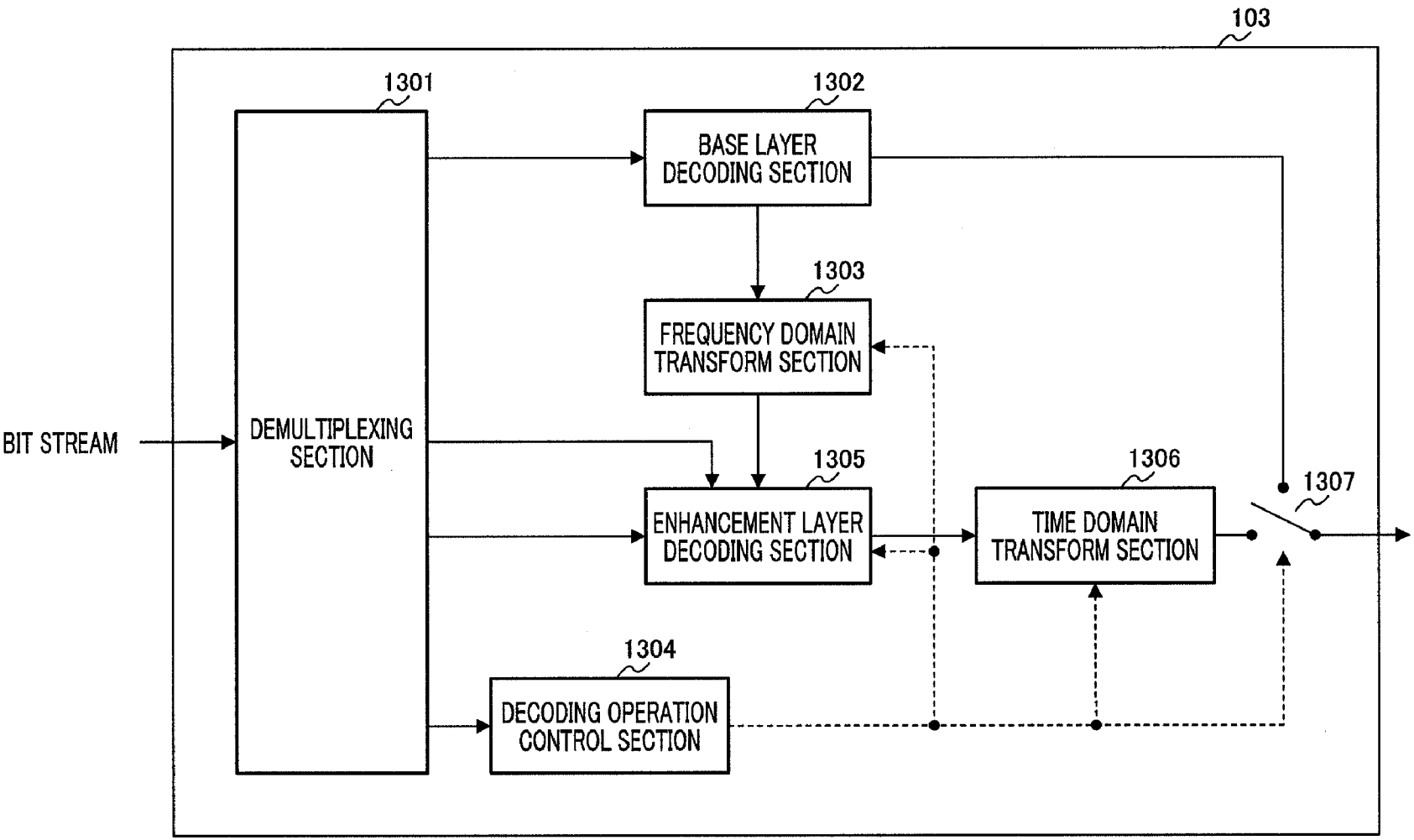
FIG. 13 is a block diagram showing a configuration of a decoding apparatus according to Embodiment 2 of the present invention.

FIG. 13 is a block diagram showing main components of decoding apparatus 103 according to the present embodiment. In FIG. 13, decoding apparatus 103 is configured mainly with demultiplexing section 1301, base layer decoding section 1302, frequency domain transform section 1303, decoding operation control section 1304, enhancement layer decoding section 1305 and time domain transform section 1306.

Demultiplexing section 1301 demultiplexes the bit stream transmitted from coding apparatus 101 into the encoded information of the base layer, the encoded information of enhancement layer, the transmission mode information and the mode information of the enhancement layer, and outputs the base layer encoded information to base layer decoding section 1302, the enhancement layer mode information and the enhancement layer encoded information to enhancement layer decoding section 1305 and the transmission mode information to decoding operation control section 1304.

Base layer decoding section 1302 generates a decoded signal for the base layer by decoding the base layer encoded information outputted from demultiplexing section 1301 using a CELP type speech decoding method, and outputs the generated base layer decoded signal to frequency domain transform section 1303 and control switch 1307. Here, the internal configuration of base layer decoding section 1302 is the same as in base layer decoding section 203 in FIG. 5 and explanations thereof will be omitted.

Frequency domain transform section 1303 performs a modified discrete cosine transform (Modified Discrete Cosine Transform) for the decoded signal for the base layer inputted from base layer decoding section 1302, and outputs the base layer decoded MDCT coefficient acquired as a frequency domain parameter, to enhancement layer decoding section 1305.

Based on the transmission mode information inputted from demultiplexing section 1301, decoding operation control section 1304 performs the on/off control of control switch 1307 and operations of frequency domain transform section 1303, enhancement layer decoding section 1305 and time domain transform section 1306. To be more specific, when the transmission mode information shows BR2, decoding operation control section 1304 makes operations of frequency domain transform section 1303, enhancement layer decoding section 1305 and time domain transform section 1306 all on, and connects control switch 1307 to the side of time domain transform section 1306. Further, when the transmission mode information shows BR1, decoding operation control section 1304 makes operations of frequency domain transform section 1303, enhancement layer decoding section 1305 and time domain transform section 1306 all off, and connects control switch 1307 to the side of base layer decoding section 1302. Thus, decoding operation control section 1304 performs the on/off control of control switches and processing blocks according to transmission mode information, thereby determining combinations of coding sections for use to decode encoded information.

Enhancement layer decoding section 1305 receives as input the enhancement layer decoded information and mode information of the enhancement layer from demultiplexing section 1301 and the base layer decoded MDCT coefficient $X''1_k$ from frequency domain transform section 1303. When decoding operation control section 1304 controls enhancement layer decoding section 1305 off, enhancement layer decoding section 1305 calculates additional MDCT coefficient $X''_k$ from the inputted information and outputs the result to time domain transform section 1306. When decoding operation control section 1304 controls enhancement layer decoding section 1305 off, enhancement layer decoding section 1305 does not operate. Processing in enhancement layer decoding section 1305 will be described later in detail.

When decoding operation control section 1304 controls time domain transform section 1306 off, time domain transform section 1306 performs an inverse modified discrete cosine transform for the additional MDCT coefficient $X''_k$ inputted from enhancement layer decoding section 1305, and outputs the decoded signal acquired as the time domain component to control switch 1307. When decoding operation control section 1304 controls time domain transform section 1306 off, time domain transform section 1306 does not operate.

Processing will be explained below in a case where time domain transform 1306 is controlled on. Time domain transform 1306 includes buffer $buf'_k$ to be initialized according to following equation 14.

[14]

$$buf_k'=0\ (k=0, \ldots, N-1) \qquad \text{(Equation 14)}$$

Time domain transform section 1306 finds enhancement layer signal $Y_n$, according to following equation 15, using the additional decoding MDCT coefficient $X''_k$ inputted from enhancement layer decoding section 1305. In this equation 15, $X'_k$ is the vector combining decoding MDCT coefficient X" and buffer $buf'_k$, and is found using following equation 16.

(Equation 15)

$$Y_n = \frac{2}{N}\sum_{n=0}^{2N-1} X''3_k \cos\left[\frac{(2n+1+N)(2k+1)\pi}{4N}\right] \qquad [15]$$

$$(n = 0, \ldots, N-1)$$

(Equation 16) □

$$X''3_k = \begin{cases} buf_k'' & (k = 0, \ldots N-1) \\ X_k'' & (k = N, \ldots 2N-1) \end{cases} \qquad [16]$$

Next, time domain transform section 1306 updates buffer $buf'_k$ according to following equation 17.

[17]

$$buf'_k=X''_k\ (k=0, \ldots N-1) \qquad \text{(Equation 17)}$$

Time domain transform section 1306 outputs the found decoded signal for the enhancement layer $Y_n$ to control switch 1307.

According to the control by decoding operation control section 1304, control switch 1307 outputs as an output signal, the decoded signal for the base layer outputted from base layer decoding section 1302 or the decoded signal for the enhancement layer outputted from time domain transform section 1306.

Figure 14:
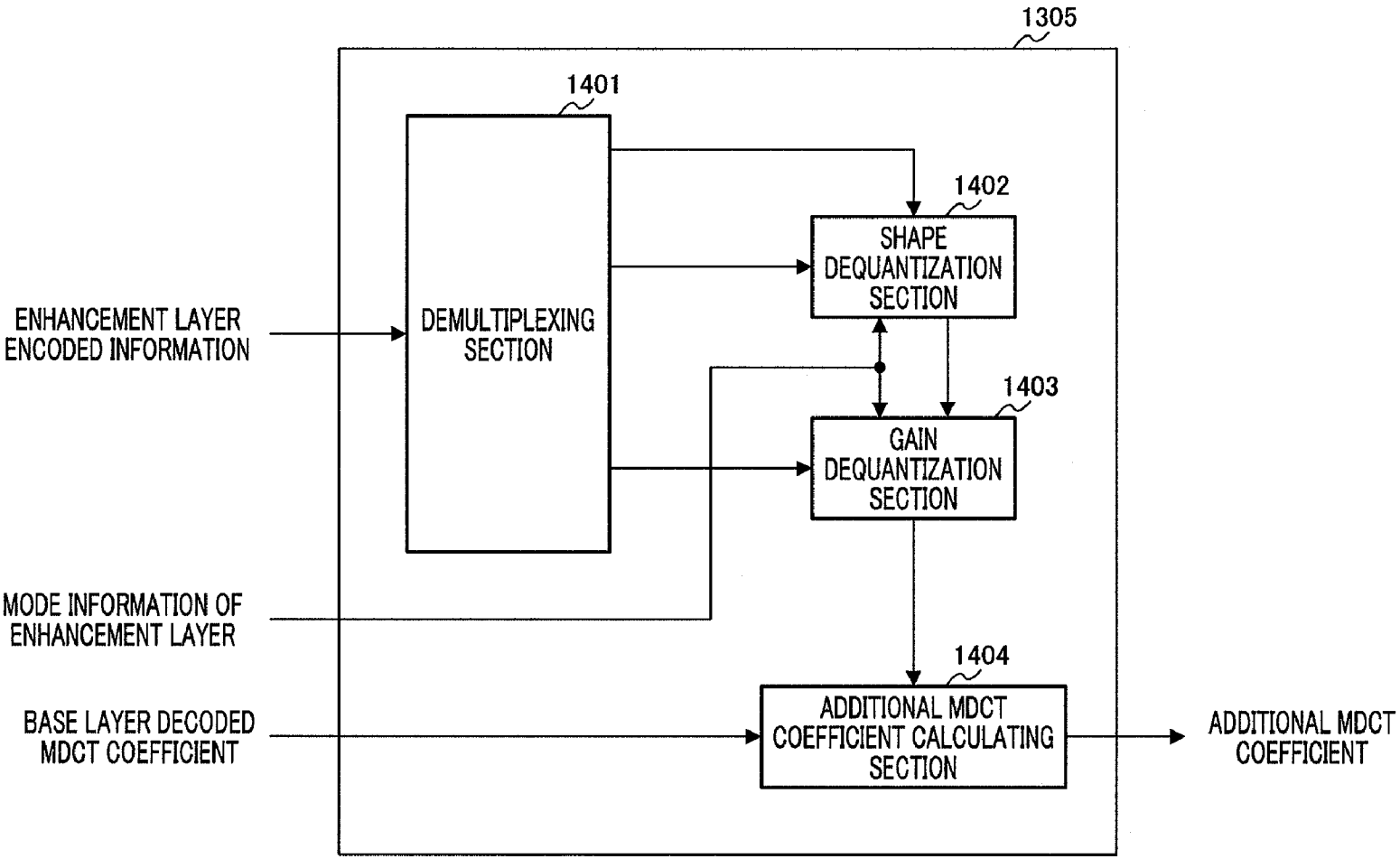
FIG. 14 is a block diagram showing an internal configuration of an enhancement layer decoding section in a decoding apparatus according to Embodiment 2 of the present invention.

FIG. 14 illustrates the internal configuration of enhancement layer decoding section 1305. Enhancement layer decoding section is configured mainly with shape dequantization section 1402, gain dequantization section 1403 and additional MDCT coefficient calculating section 1404.

Demultiplexing section 1401 demultiplexes the enhancement layer encoded information inputted from demultiplexing section 1301 into the band information, shape encoded information and gain encoded information, and outputs the band information and the shape encoded information to shape dequantization section 1402 and the gain encoded information to gain dequantization section 1403. Here, if demultiplexing section 1401 is not provided, these items of information may be multiplexed in demultiplexing section 1301 and directly inputted to and shape dequantization section 1402 and gain quantization section 1403.

Shape dequantization section 1402 includes the same shape codebook similar as in shape quantization section 1203, and searches for a shape code vector having the shape encoded information S_max as the index inputted from demultiplexing section 1401. In this case, when the mode information of the enhancement layer inputted from demultiplexing section 1401 represents Mode A, shape dequantization section 1402 searches an inner shape codebook comprised of SQA shape code vectors, and outputs the searched code vector to gain dequantization section 1403, as the shape value of the MDCT coefficient of the quantization target band designated by the band information m_max inputted from demultiplexing section 1401. Further, when the enhancement layer mode information inputted from demultiplexing section 1401 represents Mode A, shape dequantization section 1402 searches an inner shape codebook comprised of SQB shape code vectors, and outputs the searched code vector to gain dequantization section 1403, as the shape value of the MDCT coefficient of the quantization target band designated by the band information m_max inputted from demultiplexing section 1401. Here, the shape code vector searched as a shape value is Shape_q(k) (k=B(j"), . . . , B(j"+L)−1).

Gain dequantization section 1403 includes a gain codebook similar to in gain quantization section 1204 and performs dequantization for the gain value according to following equation 18. Here, vector dequantization is performed using the gain value as an L-dimension vector. In this case, when the mode information of the enhancement layer inputted from demultiplexing section 1401 represents Mode A, gain dequantization section 1403 searches the inner gain codebook comprised of GQA gain code vectors and performs dequantization for the gain value. Further, when the enhancement layer mode information inputted from demultiplexing section 1401 represents Mode B, gain dequantization section 1403 searches the inner gain codebook comprised of GQB gain code vectors and performs dequantization for the gain value.

[18]

$$\text{Gain_}q'(j+j'')=GC_j^{G_min}\ (j=0,\ldots,L-1,) \qquad \text{(Equation 18)}$$

Next, gain dequantization section 1403 calculates the MDCT coefficients in the enhancement layer according to following equation 19, using the gain value acquired by dequantization and the shape value inputted from shape dequantization section 1402. Here, the decoded MDCT coefficient is $X''_k$.

(Equation 19)

$$X''2_k = \text{Gain_q}'(j)\cdot\text{Shape_q}'(k) \qquad [19]$$
$$\begin{pmatrix} k = B(j''),\ \ldots\ ,B(j''+L)-1 \\ j = j'',\ \ldots\ ,j''+L-1 \end{pmatrix}$$

Gain quantization section 1403 outputs the enhancement layer MDCT coefficient $X''\mathbf{2}_k$ calculated according to above equation 19.

Additional MDCT coefficient calculating section 1404 adds the base layer decoded MDCT coefficient $X''\mathbf{1}_k$ inputted from frequency domain transform section 1303 and the enhancement layer decoded MDCT coefficient $X''\mathbf{2}_k$ inputted from gain dequantization section 1403, and outputs the acquired addition result to time domain transform section 1306 as additional MDCT coefficient $X''_k$.

As described above, according to the present embodiment, in a scalable coding method in which a CELP type speech coding method is used in a lower layer and a transform coding method is used in a higher layer, by switching the coding method in the higher layer (bit allocation) according to the coding result of the lower layer, it is possible to provide an output signal of good quality.

Further, although an example case has been described above with the present embodiment where the coding apparatus controls the coding mode of a higher layer based on the LPC quantization error in a lower layer, the present invention is not limited to this and it is equally possible to control the coding mode in a higher layer based on other layer parameters than the LPC quantization error. An example case will be explained below where the higher layer coding mode is controlled based on the SNR of the lower layer synthesis signals. In this case, the SNR of a synthesis signal synthesized from the LPC quantized coefficient outputted from LPC quantization section 403 and a value multiplying the adaptive excitation code outputted from adaptive excitation codebook 406 by a gain, is calculated in filter 404 of base layer coding section 1002 and outputted to enhancement layer mode information determining section 1102 of enhancement layer control section 1003. Enhancement layer mode information determining section 1102 compares the inputted SNR and a threshold stored in advance, determines mode information of the enhancement layer according to this comparison result and outputs the result to enhancement layer coding section 1008. To be more specific, when the SNR outputted from base layer coding section 1002 is greater than the threshold, enhancement layer mode information determining section 1102 makes the enhancement layer mode Mode A, and, when the SNR outputted from base layer coding section 1002 is equal to or less than the threshold, makes the enhancement layer mode Mode B.

Further, the method of determining the mode of the enhancement layer may be reversed. That is, when the SNR outputted from base layer coding section 1002 is greater than the threshold, enhancement layer mode information determining section 1102 makes the enhancement layer mode Mode B, and, when the SNR outputted from base layer coding section 1002 is equal to or less than the threshold, makes the enhancement layer mode Mode A.

Further, although a case has been described above with the present embodiment where the coding apparatus performs CELP type coding in a lower layer and transform coding in a higher layer, the present invention is not limited to this and is also applicable to cases where, in a higher layer, the LPC parameters are quantized and furthermore the excitation component is subjected to transform coding. To be more specific, for example, the present invention is applicable to a case where the bits to be assigned to the LPC parameters of a higher layer and the bits to be assigned for the transform coding of the excitation based on the degree of CD in the lower layer.

Embodiment 3

A case has been described above with Embodiment 2 where, in a scalable coding method in which a CELP type speech coding method is adopted in a lower layer and a transform coding method is adopted in a higher layer, the coding method in the higher layer (bit allocation) is switched using the coding result of the lower layer. In particular, although a case has been described where coding distortion of the LPC parameters is used as the lower layer coding result, the present invention is not limited to this and is applicable to a scalable coding method in which the higher layer coding method is changed using pitch information such as the amount of pitch gain as the lower layer coding result.

A case will be explained with Embodiment 3 where, in a scalable coding method in which a CELP type speech coding method is adopted in a lower layer and a transform coding method is adopted in a higher layer, the coding method in the higher layer is changed using the amount of calculated pitch gains in the lower layer. Further, a communication system having the coding apparatus and decoding apparatus according to the present embodiment is the same as in FIG. 1 and explanations thereof will be omitted.

Figure 15:
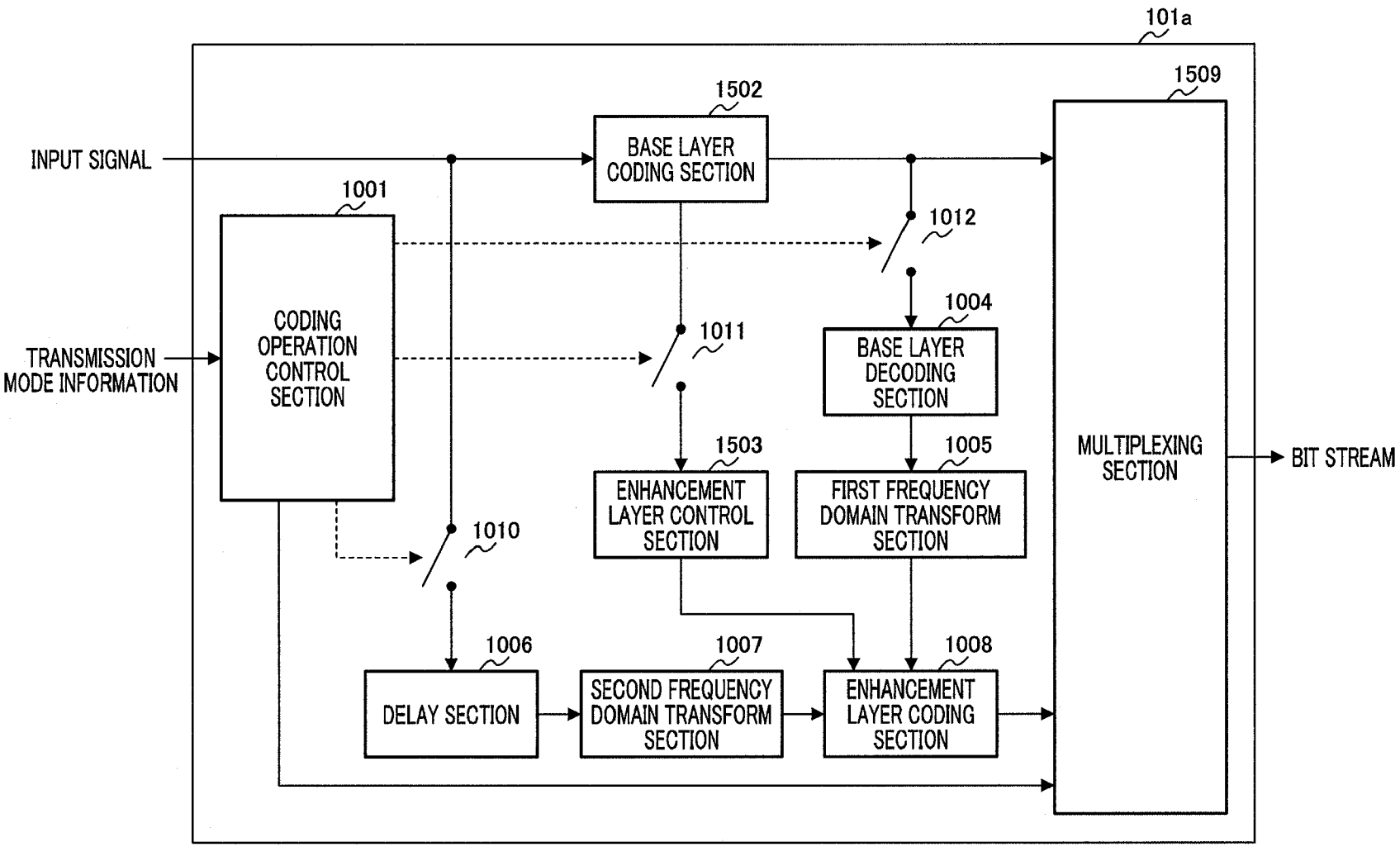
FIG. 15 is a block diagram showing a configuration of a coding apparatus according to Embodiment 3 of the present invention.

FIG. 15 is a block diagram showing the configuration of coding apparatus 101*a* according to the present embodiment. Further, in FIG. 15, the same components as in FIG. 10 will be assigned the same reference numerals and explanations thereof will be omitted.

Coding apparatus 101*a* shown in FIG. 15 is different from the coding apparatus of FIG. 10 in outputting quantized adaptive excitation gain to enhancement layer control section 1503 via control switch 1011. Further, in coding apparatus 101*a* shown in FIG. 15, the internal configuration of enhancement layer control section 1503 is different from that of enhancement layer control section 1003 in FIG. 10. Further, coding apparatus 101*a* shown in FIG. 15 is different from the coding apparatus of FIG. 10 in that enhancement layer control section 1503 outputs the mode information of the enhancement layer only to enhancement layer coding section 1008. Further, coding apparatus 101*a* shown in FIG. 15 is different from the coding apparatus of FIG. 10 in that the amount of information multiplexed in multiplexing section 1509 is different from the multiplexing section of FIG. 19.

Figure 16:
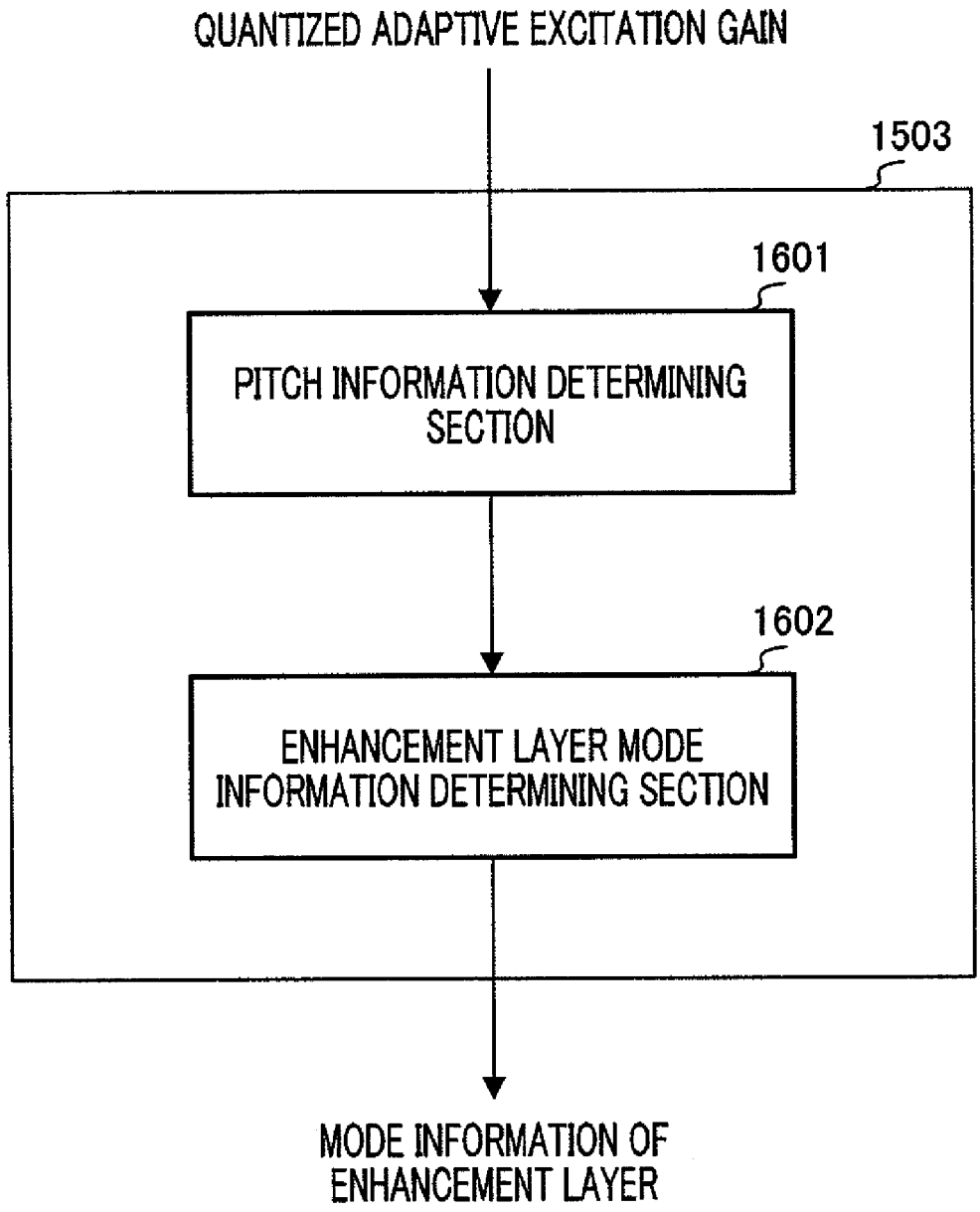
FIG. 16 is a block diagram showing an internal configuration of an enhancement layer control section in a coding apparatus according to Embodiment 3 of the present invention.

FIG. 16 shows the internal configuration of enhancement layer control section 1503 of FIG. 15. Enhancement layer control section 1503 is configured mainly with pitch information determining section 1601 and enhancement layer mode information determining section 1602.

Pitch information determining section 1601 calculates an absolute value of the value of the inputted quantized adaptive excitation gain and outputs the result to enhancement layer mode information determining section 1602 as an absolute value quantized adaptive excitation gain.

Enhancement layer mode information determining section 1602 compares the absolution value quantized adaptive excitation gain outputted from pitch information determining section 1601 and a predetermined threshold held in enhancement layer mode information determining section 1602, determines the coding mode of the enhancement layer according to this comparison result, and outputs mode information of the enhancement layer showing the coding mode to enhancement layer coding section 1008. To be more specific, when the comparison result shows that the absolution value quantized adaptive excitation gain is greater than the threshold, that is, when the periodicity of speech components is high, enhancement layer mode information determining section 1602 makes the coding mode of the enhancement layer Mode A. On the other hand, when the comparison result shows that the absolution value quantized adaptive excitation gain is equal to or less than the threshold, that is, when the periodicity of the speech components is low, enhancement layer mode information determining section 1602 makes the coding mode of the enhancement layer Mode B.

Figure 17:
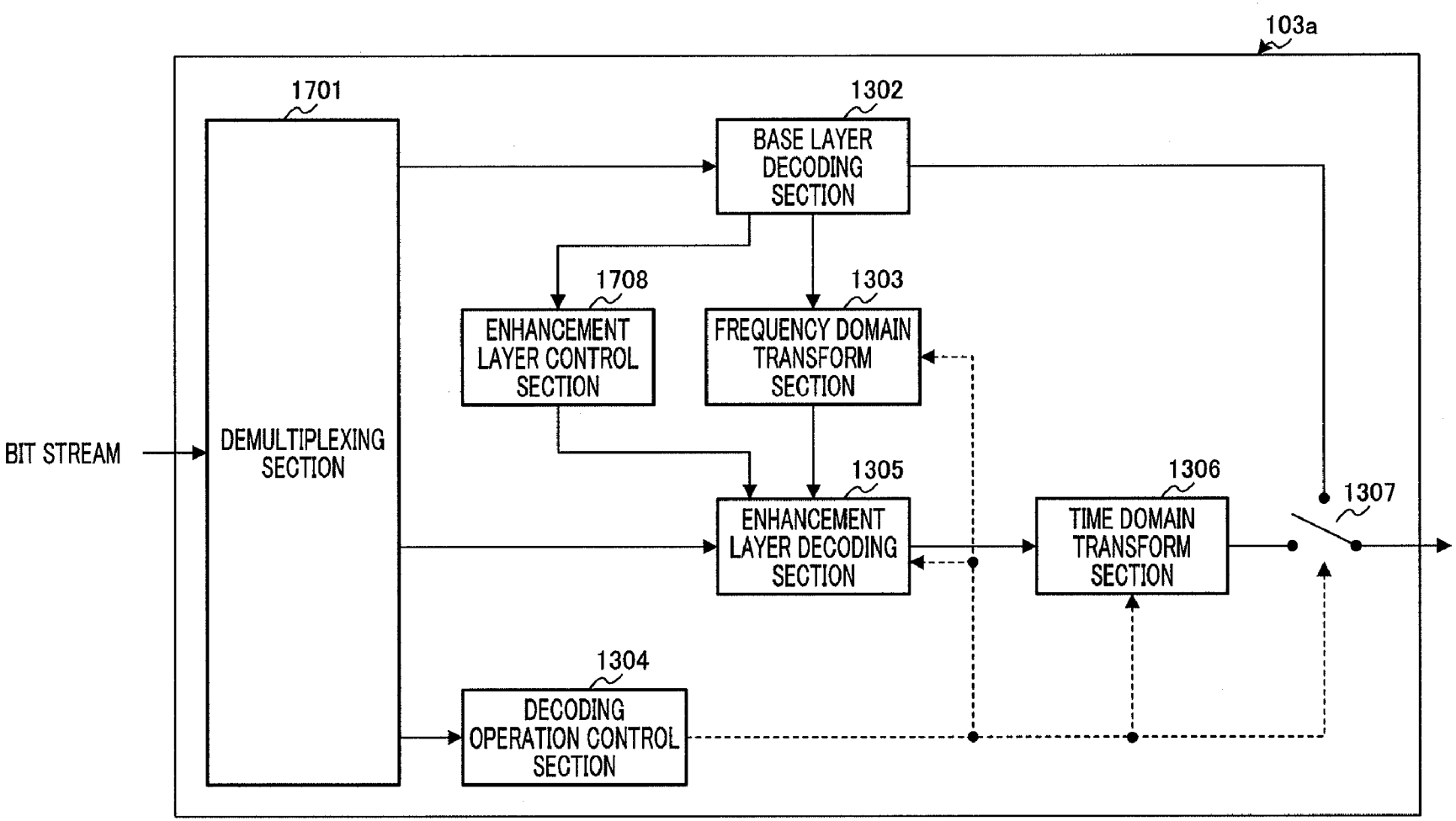
FIG. 17 is a block diagram showing a decoding apparatus according to Embodiment 3 of the present invention.

FIG. 17 is a block diagram showing main components of decoding apparatus 103*a* according to the present embodiment. Further, in FIG. 17, the same components as in FIG. 13 will be assigned the same reference numerals and explanations thereof will be omitted.

Decoding apparatus 103*a* of FIG. 17 employs a configuration having enhancement layer control section 1708 in addition to the configuration of FIG. 13. Further, in decoding apparatus 103*a* of FIG. 17, mode information of the enhancement layer is not inputted from demultiplexing section 1701 to enhancement layer decoding section 1305, and the processing of inputting the enhancement layer mode information from demultiplexing section 1301 to enhancement layer decoding section 1305 in FIG. 13 is replaced by processing of inputting quantized adaptive excitation gain from base layer decoding section 1302 to enhancement layer control section 1708 at first and inputting the enhancement layer mode information from enhancement layer control section 1708 to enhancement layer decoding section 1305.

Here, the internal configuration of enhancement layer control section 1708 is the same as in enhancement layer control section 1503 and explanations thereof will be omitted.

As described above, according to the present embodiment, in a scalable coding method in which a CELP type speech coding method is used in a lower layer and a transform coding method is used in a higher layer, by switching the coding method in the higher layer (bit allocation) according to the coding result of the lower layer (quantized adaptive excitation gain), it is possible to provide an output signal of good quality. To be more specific, taking into account the lower layer coding result, by increasing the number of bits to be assigned in shape quantization when the periodicity of the signal to be quantized is short and decreasing the number of bits to be assigned in shape quantization when the periodicity of the signal to be quantized is long, it is possible to perform more efficient coding. Further, when the above configuration is employed, unlike Embodiment 2, the mode information of the enhancement layer need not be included in bit streams, so that it is possible to perform coding at lower bit rates.

Further, although a case has been described with the present embodiment where the coding method in the higher layer is switched using a quantized adaptive excitation gain as the coding result of the lower layer, the present invention is not limited to this and is applicable to a scalable coding method in which the higher layer coding method is switched using an ideal adaptive excitation gain that can be calculated from the adaptive excitation vector calculated in the lower layer and the excitation vector to be quantized. Further, if this method is employed, the mode information of the enhancement layer needs to be transmitted from enhancement layer coding section 1008 included in the coding apparatus to multiplexing section 1509. Further, in this case, on the decoding apparatus, enhancement layer decoding section 1305 acquires the enhancement layer mode information from demultiplexing section 1701, and, consequently, need not have enhancement layer control section 1708.

Further, although a case has been described above with the present embodiment where the coding apparatus compares quantized adaptive excitation gain, used as the coding result in a lower layer, to a predetermined certain threshold in the coding apparatus, the present invention is not limited to this and is applicable to cases of utilizing the distortion of parameters such as the adaptive excitation code, fixed excitation code and gain. For example, assume that, when the adaptive excitation code is used, the coding method in the higher layer is switched according to the length of a pitch period shown by the adaptive excitation code that is the lower layer coding result. To be more specific, assume that, when the pitch period shown by the adaptive excitation code representing the coding result of the lower layer is equal to or less than a threshold, that is, when the periodicity of the signal to be quantized is short, the mode information of the enhancement layer is set Mode A and the number of bits to be assigned in shape quantization in the higher layer is increased, and, when the pitch period is greater than the threshold, that is, when the periodicity of the signal to be quantized is long, the mode information of the enhancement layer is set Mode B and the number of bits to be assigned in shape quantization in the higher layer is decreased.

Further, of course, the conditions for determining mode information of the enhancement layer can be reversed. That is, when a pitch period shown by the adaptive excitation code representing the coding result of the lower layer is equal to or less than a threshold, the mode information of the enhancement layer is set Mode B, and, when the pitch period is greater than the threshold, the mode information of the enhancement layer is set Mode A. In the above embodiment, this configuration can be acquired by merely replacing the adaptive excitation code by the quantized adaptive excitation gain as the coding result for use, and, consequently, explanations will be omitted.

Further, although a case has been described with the present embodiment where the mode information of the enhancement layer is set Mode A when a pitch period shown by the adaptive excitation code representing the coding result of the lower layer is greater than a threshold and the mode information of the enhancement layer is set Mode B when the pitch period is equal to or less than a threshold, the present invention is not limited to this and is applicable to cases where the enhancement layer mode information is set Mode A when a pitch period shown by the adaptive excitation code representing the lower layer coding result is equal to or less than a threshold and the enhancement layer mode information is set Mode B when the pitch period is greater than a threshold.

Embodiment 4

A case has been described with Embodiment 2 where, in a scalable coding method in which a CELP type speech coding method is adopted in a lower layer and a transform coding method is adopted in a higher layer, the coding method (bit allocation) in the higher layer is changed using the coding result of the lower layer. In the above explanations, although the band to be quantized is the same between the lower layer and the higher layer, the present invention is not limited to this and is also applicable to cases where the band to be quantized is different between these layers.

A configuration will be explained with Embodiment 4 where, when the band to be quantized is different between a lower layer and a higher layer, the coding method in the higher layer is switched according to the coding result of the lower layer. Here, a communication system having the coding apparatus and the decoding apparatus according to the present embodiment is the same as in FIG. 1 and explanations thereof will be omitted.

Figure 18:
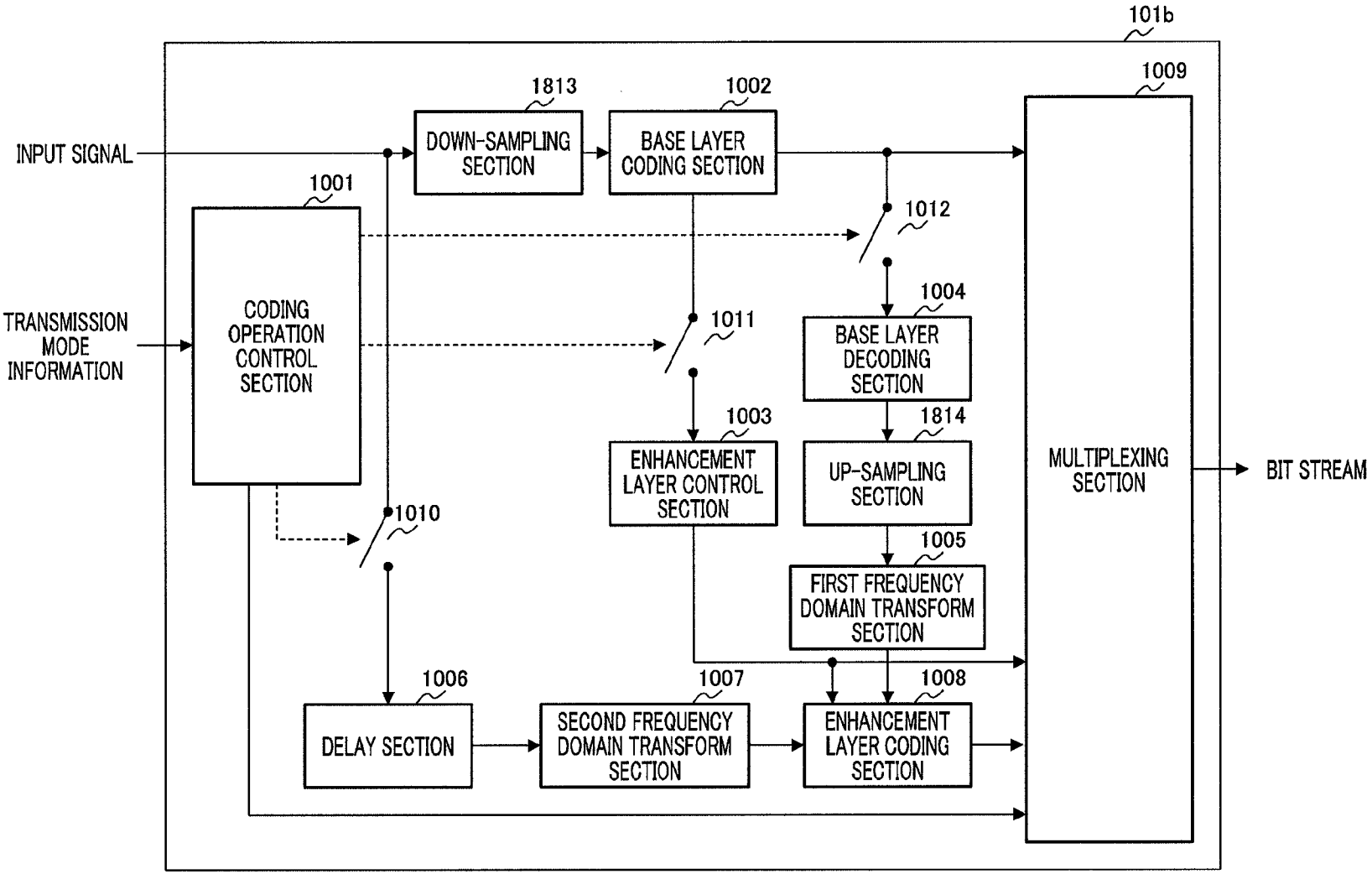
FIG. 18 is a block diagram showing a configuration of a coding apparatus according to Embodiment 4 of the present invention.

FIG. 18 is a block diagram showing the configuration of coding apparatus 101*b* according to the present embodiment. Further, in FIG. 18, the same components as in FIG. 10 will be assigned the same reference numerals and explanations thereof will be omitted.

Coding apparatus 101*b* of FIG. 18 employs a configuration adding downsampling section 1813 and upsampling section 1814 to the configuration of FIG. 10.

Downsampling section 1813 performs downsampling processing for an input signal, changes the sampling frequency of the input signal from Rate 1 to Rate 2 (Rate 1>Rate 2) and outputs the result to base layer coding section 1002.

Upsampling section 1814 performs upsampling processing for the decoded signal for the base layer inputted from base layer decoded section 1004, changes the sampling frequency of the decoded signal for the base layer from Rate 2 to Rate 1 and outputs the result to first frequency domain transform section 1005.

Figure 19:
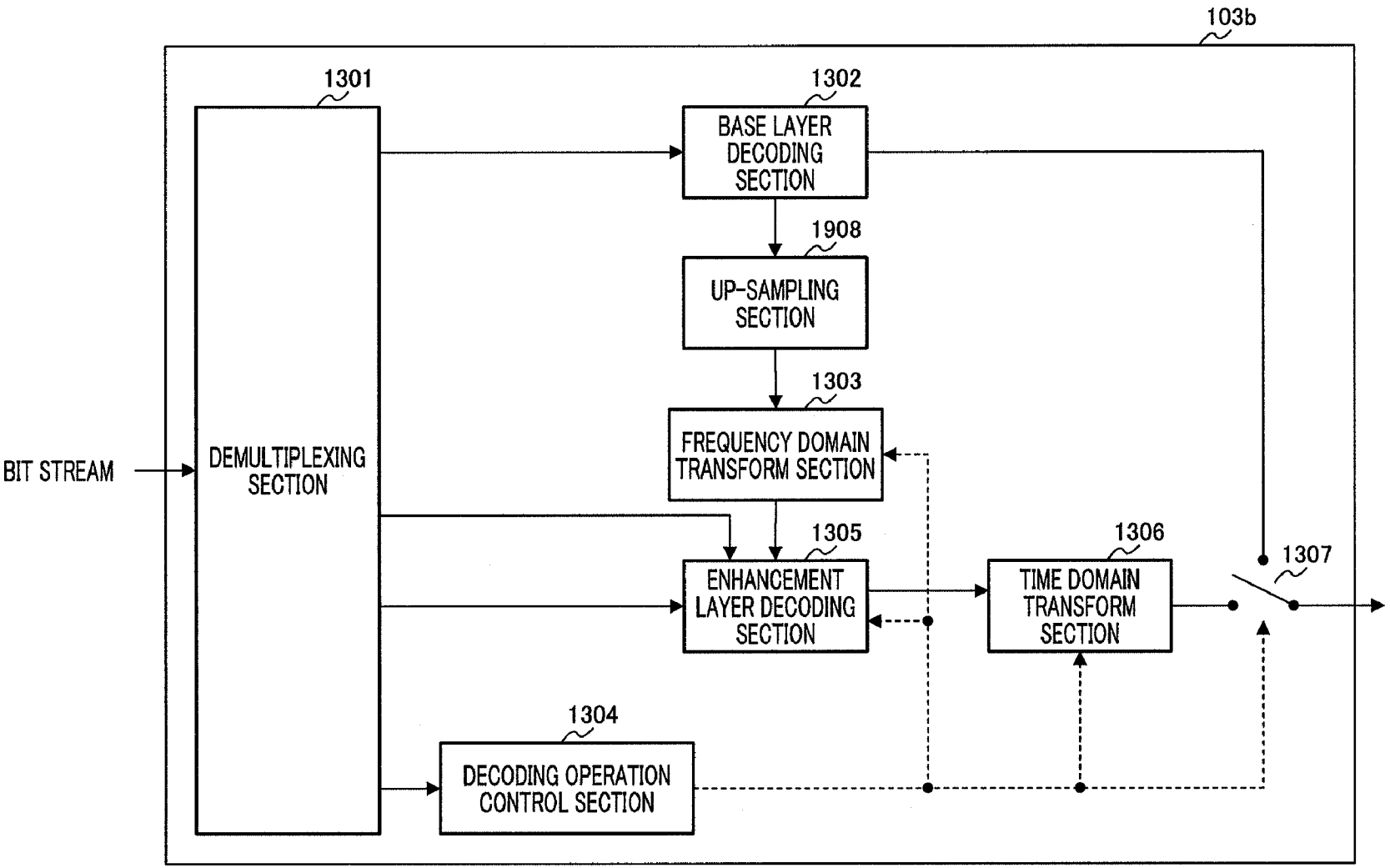
FIG. 19 is a block diagram showing a configuration of a decoding apparatus according to Embodiment 4 of the present invention.

FIG. 19 is a block diagram showing the configuration of decoding apparatus 103*b* according to the present embodiment. Further, in FIG. 19, the same components as in FIG. 13 will be assigned the same reference numerals and explanations thereof will be omitted.

Decoding apparatus 103*b* of FIG. 19 employs a configuration adding upsampling section 1908 to the configuration of FIG. 13.

Upsampling section 1908 performs upsampling processing for the decoded signal for the base layer inputted from base layer decoded section 1302, changes the sampling frequency of the decoded signal for the base layer from Rate 2 to Rate 1 and outputs the result to frequency domain transform section 1303.

As described above, according to the present embodiment, in a scalable coding method in which a CELP type speech coding method is used in a lower layer and a transform coding method is used in a higher layer, by switching the coding method (bit allocation) in the higher layer according to the coding result (quantized adaptive excitation gain) in the lower layer, it is possible to provide an output signal of good quality.

Further, although an example case has been described above with the present embodiment where the coding apparatus controls the coding mode of a higher layer based on LPC quantization error in a lower layer, the present invention is not limited to this and it is equally possible to control the coding mode for a higher layer based on other lower layer parameters than LPC quantization error. An example case will be explained below where the coding mode in a higher layer is controlled based on the SNR of the synthesis signal in a lower layer. In this case, the SNR of a synthesis signal synthesized from the LPC quantized coefficients outputted from LPC quantization section 403 and the value multiplying the adaptive excitation code outputted from adaptive excitation codebook 406 by a gain, is calculated in filter 404 of base layer coding section 1002 and outputted to enhancement layer mode information determining section 1102 in enhancement layer control section 1003. Enhancement layer mode information determining section 1102 compares the inputted SNR and a threshold stored in advance in this section, determines the mode information of the enhancement layer according to the comparison result and outputs the determined enhancement layer mode information to enhancement layer coding section 1008. To be more specific, when the SNR outputted from base layer coding section 1002 is greater than the threshold, enhancement layer mode information determining section 1102 makes the enhancement layer mode Mode A, and, when the SNR outputted from base layer coding section 1002 is equal to or less than the threshold, makes the enhancement layer mode Mode B.

Further, the method of determining the mode of the enhancement layer may be reversed. That is, when the SNR outputted from base layer coding section 1002 is greater than the threshold, enhancement layer mode information determining section 1102 makes the enhancement layer mode Mode B, and, when the SNR outputted from base layer coding section 1002 is equal to or less than the threshold, makes the enhancement layer mode Mode A.

Further, although a case has been described with above embodiments where the coding apparatus changes the bit allocation of encoded information by using a different-size codebook upon coding in the higher layer utilizing the coding result of the lower layer, the present invention is not limited to this, and, to provide a speech signal of good quality further using the lower layer coding result, is also applicable to cases where the coding method in the higher layer is switched (shifting through parameters) or cases where a codebook for use is switched (shifting through parameters) and selected from a plurality of codebooks comprised of same-size different codebooks.

Further, although a case has been described with the above embodiments where the coding apparatus changes the bit allocation of encoded information under conditions that the amount of information to be used for coding is approximately fixed, the present invention is not limited to this and is also applicable to cases where the amount of information to be used for coding can be changed. For example, in a case where a threshold (such as SNR) is designated by commands from the system end or from the user end, with the above enhancement layer control method, it is possible to encode an input signal satisfying the threshold using the minimum amount of information. By this means, it is possible to realize a coding apparatus and method that reduces a channel use rate and flexibly satisfies system or user demands.

Further, although a case has been described with the above embodiments where the coding apparatus compares LPC cepstrum distance representing the coding result of a lower layer to a predetermined threshold, the present invention is not limited to this and is applicable to the coding apparatus that changes a threshold dynamically according to user command, channel conditions and a value of an LPC order by a coding method.

In addition, the present invention does not limit the layers, and are applicable to all methods of coding and decoding signals comprised of a plurality of layers, where the residual signal representing the difference between the input signal and a lower layer is encoded in a higher layer.

Further, the present invention is applicable to signal processing program that makes a computer perform signal processing operations. In addition, the present invention is also applicable to cases where this signal processing program is recorded and written on a machine-readable recording medium such as memory, disk, tape, CD, or DVD, achieving behavior and effects similar to those of the present embodiment.

Furthermore, each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration. Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible. Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2006-066771, filed on Mar. 10, 2006, and Japanese Patent Application No. 2007-032746, filed on Feb. 13, 2007, including the specifications, drawings and abstracts, being incorporated herein by reference in their entirety.

INDUSTRIAL APPLICABILITY

The present invention is suitable for a coding apparatus and decoding apparatus in a communication system using a scalable coding technique.

The invention claimed is:

1. A coding apparatus that encodes an input signal by information of n layers, where n is an integral number equal to or greater than 2, the apparatus comprising:

a base layer coder that encodes the input signal and generates encoded information of a first layer;

an i-th layer decoder that decodes encoded information of an i-th layer, where i is an integral number between 1 and n−1, and generates a decoded signal of the i-th layer;

an adder that finds one of a first layer difference signal representing a difference between the input signal and a decoded signal of the first layer, and an i-th layer difference signal representing a difference between a difference signal of an (i−1)-th layer and a decoded signal of the i-th layer;

a (i+1)-th layer enhancement layer coder that encodes the difference signal of the i-th layer and generates encoded information of a (i+1)-th layer; and an enhancement layer controller that controls a coding method in a second coder in a higher layer, which is higher than a predetermined layer according to a quantization result of coding parameters for a first coder in the predetermined layer, wherein one of the coders is a code-excited linear prediction (CELP) type coder, and the enhancement layer controller controls the coding method in the second coder in the higher layer than the predetermined layer such that quantization is performed using a first linear prediction coefficient (LPC) codebook when an LPC quantization error in the first coder in the predetermined layer is greater than a predetermined threshold and quantization is performed using a second LPC codebook of a smaller size than the first LPC codebook when the LPC quantization error in the first coder in the predetermined layer is equal to or less than the predetermined threshold.

2. The coding apparatus according to claim 1, wherein one of the coders is a CELP type coder, and the enhancement layer controller controls the coding method in the second coder in the higher layer than the predetermined layer such that quantization is performed using a first fixed excitation codebook when an LPC quantization error in the first coder in the predetermined layer is greater than a predetermined threshold and quantization is performed using a second fixed excitation codebook of a larger size than the first fixed excitation codebook when the LPC quantization error in the first coder in the predetermined layer is equal to or less than the predetermined threshold.

3. The coding apparatus according to claim 1, wherein one of the coders is a CELP type coder, and the enhancement layer controller controls the coding method in the second coder in the higher layer than the predetermined layer such that quantization is performed using a first shape codebook when an LPC quantization error in the first coder in the predetermined layer is greater than a predetermined threshold and quantization is performed using a second shape codebook of a smaller size than the first shape codebook when the LPC quantization error in the first coder in the predetermined layer is equal to or less than the predetermined threshold.

4. The coding apparatus according to claim 1, wherein one of the coders is a CELP type coder, and the enhancement layer controller controls the coding method in the second coder in the higher layer than the predetermined layer such that quantization is performed using a first gain codebook when an LPC quantization error in the first coder in the predetermined layer is greater than a predetermined threshold and quantization is performed using a second gain codebook of a smaller size than the first gain codebook when the LPC quantization error in the first coder in the predetermined layer is equal to or less than the predetermined threshold.

5. The coding apparatus according to claim 1, wherein one of the coders is a CELP type coder, and the enhancement layer controller controls the coding method in the second coder in the higher layer than the predetermined layer such that quantization is performed using a first shape codebook when an LPC pitch gain in the first coder in the predetermined layer is greater than a predetermined threshold and quantization is performed using a second shape codebook of a smaller size than the first shape codebook when the LPC pitch gain in the first coder in the predetermined layer is equal to or less than the predetermined threshold.

6. The coding apparatus according to claim 1, wherein one of the coders is a CELP type coder, and the enhancement layer controller controls the coding method in the second coder in the higher layer than the predetermined layer such that quantization is performed using a first gain codebook when an LPC pitch gain in the first coder in the predetermined layer is greater than a predetermined threshold and quantization is performed using a second gain codebook of a smaller size than the first gain codebook when the LPC pitch gain in the first coder in the predetermined layer is equal to or less than the predetermined threshold.

7. A coding method that encodes an input signal by information of n layers, where n is an integral number greater than 2, comprising:

encoding, by a base layer coder, the input signal and generating encoded information of a first base layer;

decoding, by an i-th layer decoder, encoded information of an i-th layer, where i is an integral number at least equal to 1 and not more than n−1, and generating a decoded signal of the i-th layer;

finding, by an adder, a difference signal of a first layer representing a difference between the input signal and a decoded signal of the first base layer or a difference signal of an i-th layer representing a difference between a difference signal of a (i−1) layer and the decoded signal of the i-th layer;

encoding, by an (i+1)-th layer coder, the difference signal of the i-th layer and generating encoded information of a (i+1)-th layer; and controlling the coding method, by an enhancement layer controller, in a second coder in a higher layer, which is higher than a predetermined layer according to a quantization result of coding parameters of a first coder in the predetermined layer, wherein one of the coders is a code-excited linear prediction (CELP) type coder, and the enhancement layer controller controls the coding method in the second coder in the higher layer than the predetermined layer such that quantization is performed using a first linear prediction coefficient (LPC) codebook when an LPC quantization error in the first coder in the predetermined layer is greater than a predetermined threshold and quantization is performed using a second LPC codebook of a smaller size than the first LPC codebook when the LPC quantization error in the first coder in the predetermined layer is equal to or less than the predetermined threshold.

8. A non-transitory computer-readable storage medium that includes a program that makes a computer perform a coding method that encodes an input signal by encoded information of n layers, where n is an integral number greater than 2, comprising:

encoding, by a base layer coder, the input signal and generating encoded information of a first base layer;

decoding, by an ith layer decoder, encoded information of an i-th layer, where i is an integral number at least equal to 1 and not more than n−1, and generating a decoded signal of the i-th layer;

finding, by an adder, a difference signal of a first layer representing a difference between the input signal and a decoded signal of the first base layer or a difference signal of an i-th layer representing a difference between a difference signal of a (i−1) layer and the decoded signal of the i-th layer;

encoding, by an (i+1)-th layer coder, the difference signal of the i-th layer and generating encoded information of a (i+1)-th layer; and controlling the coding method, by an enhancement layer controller, a second coder in a higher layer, which is higher than a predetermined layer according to a quantization result of coding parameters of a first coder in the predetermined layer, wherein one of the coders is a code-excited linear prediction (CELP) type coder, and the enhancement layer controller controls the coding method in the second coder in the higher layer than the predetermined layer such that quantization is performed using a first linear prediction coefficient (LPC) codebook when an LPC quantization error in the first coder in the predetermined layer is greater than a predetermined threshold and quantization is performed using a second LPC codebook of a smaller size than the first LPC codebook when the LPC quantization error in the first coder in the predetermined layer is equal to or less than the predetermined threshold.

* * * * *